US011453532B2

(12) United States Patent
Heilman

(10) Patent No.: US 11,453,532 B2
(45) Date of Patent: Sep. 27, 2022

(54) LID ASSEMBLY AND CONTAINER HAVING LID ASSEMBLY

(71) Applicant: SNACKSHAKER LLC, Melbourne, KY (US)

(72) Inventor: Charles H. Heilman, Melbourne, KY (US)

(73) Assignee: SNACKSHACKER LLC, Melbourne, KY (US)

( * ) Notice: Subject to any disclaimer, the term of this patent is extended or adjusted under 35 U.S.C. 154(b) by 0 days.

(21) Appl. No.: 16/976,208

(22) PCT Filed: Dec. 28, 2018

(86) PCT No.: PCT/US2018/068052

§ 371 (c)(1),
(2) Date: Aug. 27, 2020

(87) PCT Pub. No.: WO2019/168589

PCT Pub. Date: Sep. 6, 2019

(65) Prior Publication Data

US 2021/0002040 A1 Jan. 7, 2021

Related U.S. Application Data

(60) Provisional application No. 62/636,922, filed on Mar. 1, 2018.

(51) Int. Cl.
*B65D 47/26* (2006.01)
*B65D 25/04* (2006.01)
(Continued)

(52) U.S. Cl.
CPC ..... *B65D 47/265* (2013.01); *B65D 21/0204* (2013.01); *B65D 21/0233* (2013.01);
(Continued)

(58) Field of Classification Search
CPC .... B65D 47/265; B65D 47/261; B65D 47/20; B65D 47/24; B65D 25/04; B65D 83/06;
(Continued)

(56) References Cited

U.S. PATENT DOCUMENTS 218,759 A * 8/1879 Mead ..... A01C 7/00 222/220
1,896,976 A 2/1933 Shifferdecker
(Continued)

FOREIGN PATENT DOCUMENTS

DE 3435653 A1 * 4/1986 ..... B65D 47/0866
DE 29611833 U1 * 8/1996 ..... B65D 21/0204
(Continued)

OTHER PUBLICATIONS

Copenheaver, Blaine R.; International Search Report and Written Opinion of the International Searching Authority Issued in International App. No.: PCT/US2018/068052; dated Mar. 14, 2019; 7 pages.

(Continued)

*Primary Examiner* — J. Gregory Pickett
*Assistant Examiner* — Abigail Elizabeth Guidry
(74) *Attorney, Agent, or Firm* — Ulmer & Berne LLP

(57) ABSTRACT

A container and lid assembly are provided. The lid assembly includes an upper lid and a lower lid that cooperate to define a dispensation chamber for product that is provided in the container.

11 Claims, 27 Drawing Sheets

(51) Int. Cl.
*B65D 51/20* (2006.01)
*B65D 21/02* (2006.01)
*B65D 83/06* (2006.01)

(52) U.S. Cl.
CPC ..... *B65D 25/04* (2013.01); *B65D 47/261* (2013.01); *B65D 51/20* (2013.01); *B65D 83/06* (2013.01); *B65D 2251/0025* (2013.01); *B65D 2251/0093* (2013.01)

(58) Field of Classification Search
CPC ..... B65D 83/04; B65D 83/08; B65D 21/048; B65D 21/0238; B65D 21/0237; B65D 21/04; B65D 21/041; B65D 85/62; B65D 21/0204; B65D 21/0233; B65D 51/20; B65D 2251/0025; B65D 2251/0093; B65D 2251/0096; B65D 2543/00046; B65D 1/30; B65D 21/02; B65D 43/00; B65D 43/02; B65D 47/26; G01F 11/22; G01F 11/24; G01F 11/26; G01F 11/261; G01F 11/42; G01F 19/34; A47J 47/02
See application file for complete search history.

(56) References Cited

U.S. PATENT DOCUMENTS 2,262,897 A 11/1941 Lewis
2,464,222 A * 3/1949 Fazekas ..... G01F 19/00 141/322
2,575,294 A 11/1951 Putorak
2,584,781 A 2/1952 Beatty
2,764,309 A 9/1956 Zelonka
2,877,937 A * 3/1959 Weir ..... B65D 5/76 222/452
2,890,816 A 6/1959 Horland
2,901,150 A 8/1959 Matter
2,953,242 A 9/1960 Shaw
3,052,368 A 9/1962 Atkins et al.
3,130,874 A * 4/1964 Bulmer ..... A47G 19/34 222/142.8
3,145,880 A 8/1964 Whatley
3,258,174 A * 6/1966 Mullen ..... A47G 19/34 222/307
3,486,665 A 12/1969 La Croce
3,876,112 A * 4/1975 Kramer ..... B65D 1/04 222/132
4,164,301 A * 8/1979 Thayer ..... B65D 83/0454 206/534
4,165,812 A 8/1979 Jennison
4,288,006 A * 9/1981 Clover, Jr. ..... B65D 47/265 206/534
4,380,307 A 4/1983 Stillinger
4,522,315 A 6/1985 Rapp
4,579,245 A 4/1986 Narushko
4,583,667 A 4/1986 Fishman et al.
4,834,253 A 5/1989 Crine
4,955,503 A 9/1990 Propes
4,961,521 A * 10/1990 Eckman ..... A47G 19/24 128/203.15
4,991,737 A 2/1991 Edelman
5,007,540 A 4/1991 Beasley
5,072,849 A 12/1991 Blau
5,101,997 A 4/1992 Bagwell et al.
5,115,916 A * 5/1992 Beasley ..... A45C 7/0045 206/504
5,242,071 A * 9/1993 Goebel ..... B65D 21/0233 206/515
5,275,304 A 1/1994 Abrams
5,294,014 A 3/1994 Wyatt et al.
5,449,085 A 9/1995 Brun, Jr.
5,469,992 A * 11/1995 Jenkins ..... A47G 19/34 222/185.1
5,588,561 A * 12/1996 Ness ..... A47G 19/02 206/217
5,601,213 A 2/1997 Daniello
5,676,251 A * 10/1997 Credle, Jr. ..... A63H 33/086 206/501
5,845,816 A 12/1998 Krane
5,890,627 A * 4/1999 Storey ..... B65D 47/265 222/129
6,116,455 A 9/2000 Rossman et al.
6,123,214 A * 9/2000 Goebel ..... B65D 21/0204 206/805
6,176,384 B1 1/2001 Voloshin
6,332,551 B1 * 12/2001 Copeland ..... B65D 47/265 220/262
6,450,351 B1 * 9/2002 Thompson ..... B65D 1/04 215/6
6,550,640 B2 4/2003 Smith
6,820,767 B2 11/2004 Nicholas
7,051,894 B2 5/2006 Bames et al.
7,090,072 B1 8/2006 Elliott
7,748,579 B1 * 7/2010 Shin ..... G01F 11/261 222/450
8,261,929 B2 9/2012 Roberts
8,261,951 B2 9/2012 Webster et al.
8,534,502 B2 9/2013 Gold et al.
8,584,890 B2 11/2013 Roberts
8,720,723 B2 5/2014 Morris
8,875,926 B2 11/2014 Grajqevci
D724,893 S 3/2015 Dirks
9,005,348 B2 4/2015 Ott
D729,577 S 5/2015 Dirks
9,102,441 B1 8/2015 Orvik
9,199,767 B1 12/2015 Pheir
9,310,238 B2 * 4/2016 Kelly ..... G01F 11/263
9,322,693 B2 * 4/2016 Shepard ..... G01F 11/261
9,469,451 B2 10/2016 Dunn et al.
9,718,582 B2 * 8/2017 Hylton ..... A47G 19/2288
10,118,742 B2 11/2018 Paul
10,329,059 B1 6/2019 Heilman
10,364,089 B2 * 7/2019 Daniels, Jr. ..... B65D 1/165
2003/0089713 A1 5/2003 Belt et al.
2003/0234195 A1 * 12/2003 Earl ..... B65D 43/14 206/338
2004/0216411 A1 * 11/2004 Gonzalez ..... B65D 21/0204 52/503
2006/0283859 A1 * 12/2006 Lu ..... B65D 47/265 220/253
2007/0181600 A1 8/2007 Ben-Shlomo et al.
2007/0262097 A1 11/2007 Antal
2008/0035636 A1 2/2008 Grant et al.
2009/0250368 A1 10/2009 Earl et al.
2009/0283491 A1 * 11/2009 Wang ..... B65D 81/3283 215/6
2012/0285969 A1 11/2012 Kelly
2013/0001233 A1 * 1/2013 Hylton ..... A47G 19/23 220/592.2
2013/0180983 A1 7/2013 Krstic
2014/0076937 A1 * 3/2014 Cavalier ..... B65D 47/265 222/481
2014/0162221 A1 * 6/2014 Nwe ..... A23L 33/21 434/127
2014/0203025 A1 * 7/2014 Riggan ..... A47G 19/30 220/575
2014/0353202 A1 * 12/2014 Park ..... B65D 15/08 206/524.6
2016/0058223 A1 * 3/2016 Savenok ..... B65D 47/265 220/713
2016/0123786 A1 * 5/2016 Hanna ..... B65D 47/305 222/454
2016/0157646 A1 * 6/2016 Savenok ..... A47G 19/2288 220/592.17
2016/0376073 A1 12/2016 Douglas
2017/0305613 A1 * 10/2017 Giraud ..... B65D 83/04
2017/0361985 A1 * 12/2017 Kaminkow ..... B65D 25/04
2018/0094959 A1 * 4/2018 Gieske ..... B65D 47/261
2018/0134451 A1 * 5/2018 Chen ..... B65D 1/265
2018/0312321 A1 11/2018 Wondka

(56) References Cited

U.S. PATENT DOCUMENTS

FOREIGN PATENT DOCUMENTS

| | | | | | |
|---|---|---|---|---|---|
| DE | 202016103823 | U1 | * | 11/2016 | ..... B65D 21/086 |
| DE | 102016124459 | A1 | * | 6/2018 | ..... B65D 47/261 |
| FR | 2550168 | A1 | * | 2/1985 | ..... B65D 83/06 |
| GB | 196077 | A | * | 4/1923 | ..... B65D 47/265 |
| GB | 2370218 | A | * | 6/2002 | ..... B65D 1/265 |
| KR | 200342752 | Y1 | | 2/2004 | |
| WO | 97/14632 | A1 | | 4/1997 | |
| WO | WO-0142102 | A1 | * | 6/2001 | ..... B65D 81/261 |
| WO | WO-2006033179 | A1 | * | 3/2006 | ..... B65D 81/3288 |
| WO | 2009016568 | A1 | | 2/2009 | |
| WO | WO-2019030758 | A1 | * | 2/2019 | ..... B65D 1/04 |
| WO | WO-2019174733 | A1 | * | 9/2019 | ..... B65D 83/0427 |

OTHER PUBLICATIONS

Le Bihan, Nicolas; Extended European Search Report issued in European Patent Application No. 18908241.5, dated Jan. 26, 2022; 11 pages.

* cited by examiner

LID ASSEMBLY AND CONTAINER HAVING LID ASSEMBLY

REFERENCE TO RELATED APPLICATION

This application claims priority of U.S. provisional patent application Ser. No. 62/636,922, entitled Lid Assembly and Container Having Lid Assembly, filed Mar. 1, 2018, and hereby incorporates this provisional patent application by reference herein in its entirety.

TECHNICAL FIELD

A container and lid assembly are provided. The lid assembly includes an upper lid and a lower lid that cooperate to define a dispensation chamber for product that is provided in the container.

BACKGROUND

Conventional containers are provided with lids that facilitate selective dispensation of the contents of the container to a user.

SUMMARY

In accordance with one embodiment, a lid assembly for a container is provided, the lid assembly comprises an upper lid and a lower lid. The upper lid comprises a first base portion and a containment portion. The containment portion extends from the first base portion and comprises a first end and a second end. The containment portion defines an elongated recess and a dispensation opening located at the first end that extends through the containment portion to the elongated recess. The lower lid underlies the upper lid and is pivotally coupled with the upper lid such that the upper lid is pivotable with respect to the lower lid about an axis between a first position and a second position. The lower lid comprises a second base portion and a divider. The second base portion at least partially defines a lower opening that is in fluid communication with the elongated recess. The divider extends from the second base portion adjacent to the lower opening. The divider is at least partially disposed within the containment portion such that the lower lid and the containment portion cooperate to define a dispensation chamber that extends between the divider and to the first end of the containment portion. When the upper lid is in the first position, the lower opening is proximate the dispensation opening. When the upper lid is in the second position, the lower opening is spaced further from the dispensation opening than when the upper lid is in the first position such that a portion of the second base portion is exposed beneath the containment portion between the lower opening and the first end of the containment portion and at least partially defines the dispensation chamber. When the upper lid is in the second position, the lower lid cooperates with the containment portion to define a tortuous path that extends through the dispensation opening, through the dispensation chamber, and through the lower opening.

In accordance with another embodiment, an apparatus comprises a container and a lid assembly. The container comprises at least one compartment. The lid assembly overlies the at least one compartment. The lid assembly comprises an upper lid and a lower lid. The upper lid comprises a first base portion and a containment portion. The containment portion extends from the first base portion and comprises a first end and a second end. The containment portion defines an elongated recess and a dispensation opening located at the first end that extends through the containment portion to the elongated recess. The lower lid underlies the upper lid and is pivotally coupled with the upper lid such that the upper lid is pivotable with respect to the lower lid about an axis between a first position and a second position. The lower lid comprises a second base portion and a divider. The second base portion at least partially defines a lower opening that is in fluid communication with the elongated recess. The divider extends from the second base portion adjacent to the lower opening. The divider is at least partially disposed within the containment portion such that the lower lid and the containment portion cooperate to define a dispensation chamber that extends between the divider and to the first end of the containment portion. When the upper lid is in the first position, the lower opening is proximate the dispensation opening. When the upper lid is in the second position, the lower opening is spaced further from the dispensation opening than when the upper lid is in the first position such that a portion of the second base portion is exposed beneath the containment portion between the lower opening and the first end of the containment portion and at least partially defines the dispensation chamber. When the upper lid is in the second position, the lower lid cooperates with the containment portion to define a tortuous path that extends through the dispensation opening, through the dispensation chamber, and through the lower opening.

In accordance with yet another embodiment, an apparatus comprises a container and a lid assembly. The container comprises a first compartment and a second compartment. The lid assembly overlies the first compartment and the second compartment. The lid assembly comprises an upper lid and a lower lid. The upper lid comprises a base portion and a containment portion. The containment portion extends from the base portion and defines an elongated recess and a dispensation opening that extends through the containment portion to the elongated recess. The lower lid underlies the upper lid and is selectively, alternatively, and releasably attachable to the container in one of a first configuration and a second configuration. The lower lid defines a lower opening. The upper lid is releasably attached to the lower lid and is movable with respect to the lower lid between a first position and a second position. When the upper lid is in the first position, the base portion overlies the lower opening. When the upper lid is in the second position, the lower lid and the containment portion of the upper lid cooperate to define a dispensation chamber that extends between the lower opening and the dispensation opening. When the lower lid is in the first configuration, the lower opening is positioned over the first compartment. When the lower lid is in the second configuration, the lower opening is positioned over the second compartment.

BRIEF DESCRIPTION OF THE DRAWINGS

It is believed that certain embodiments will be better understood from the following description taken in conjunction with the accompanying drawings in which.

DETAILED DESCRIPTION

Figure 1:
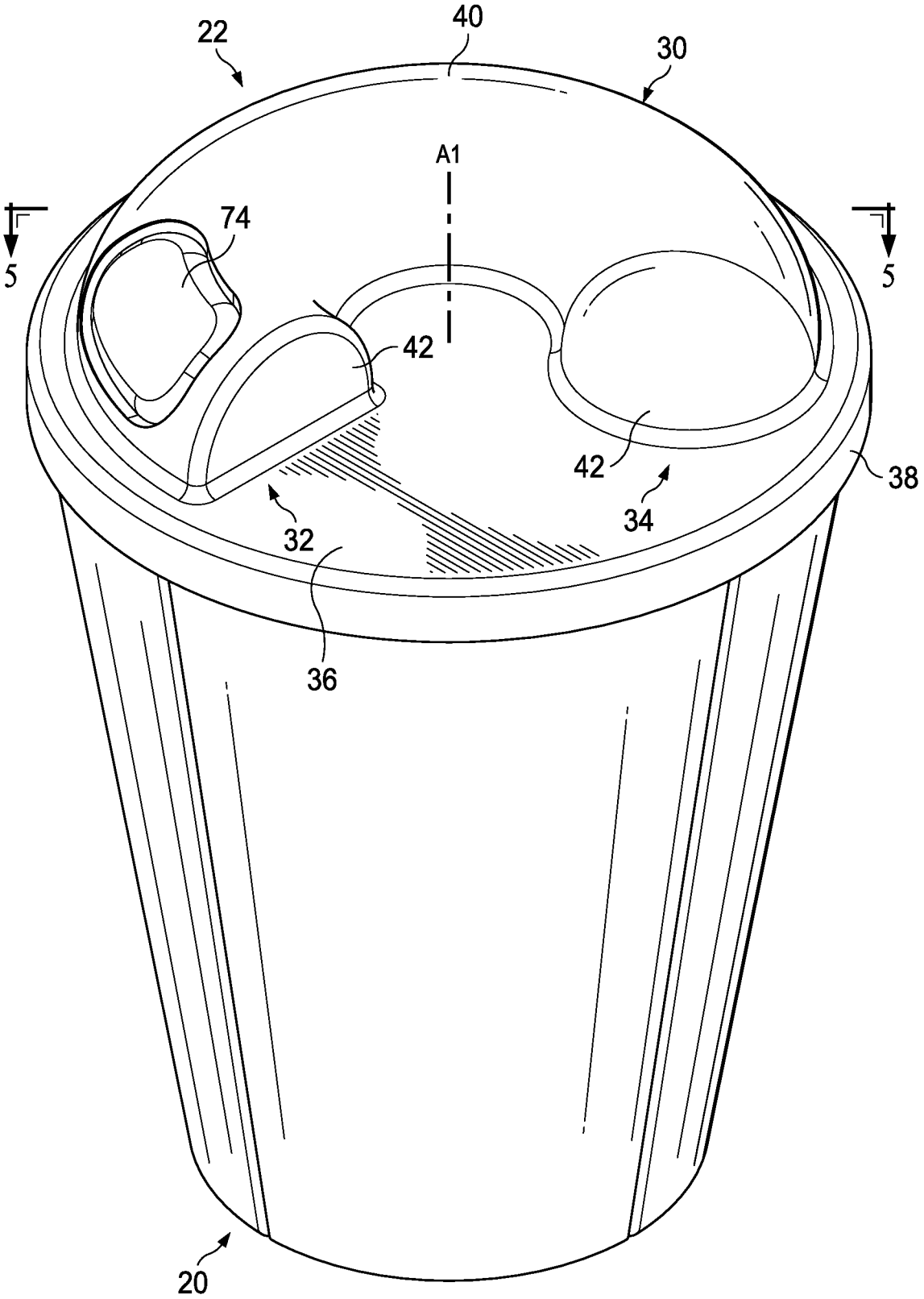
FIG. 1 is an isometric view depicting a container in association with a lid assembly, in accordance with one embodiment.
Figure 2:
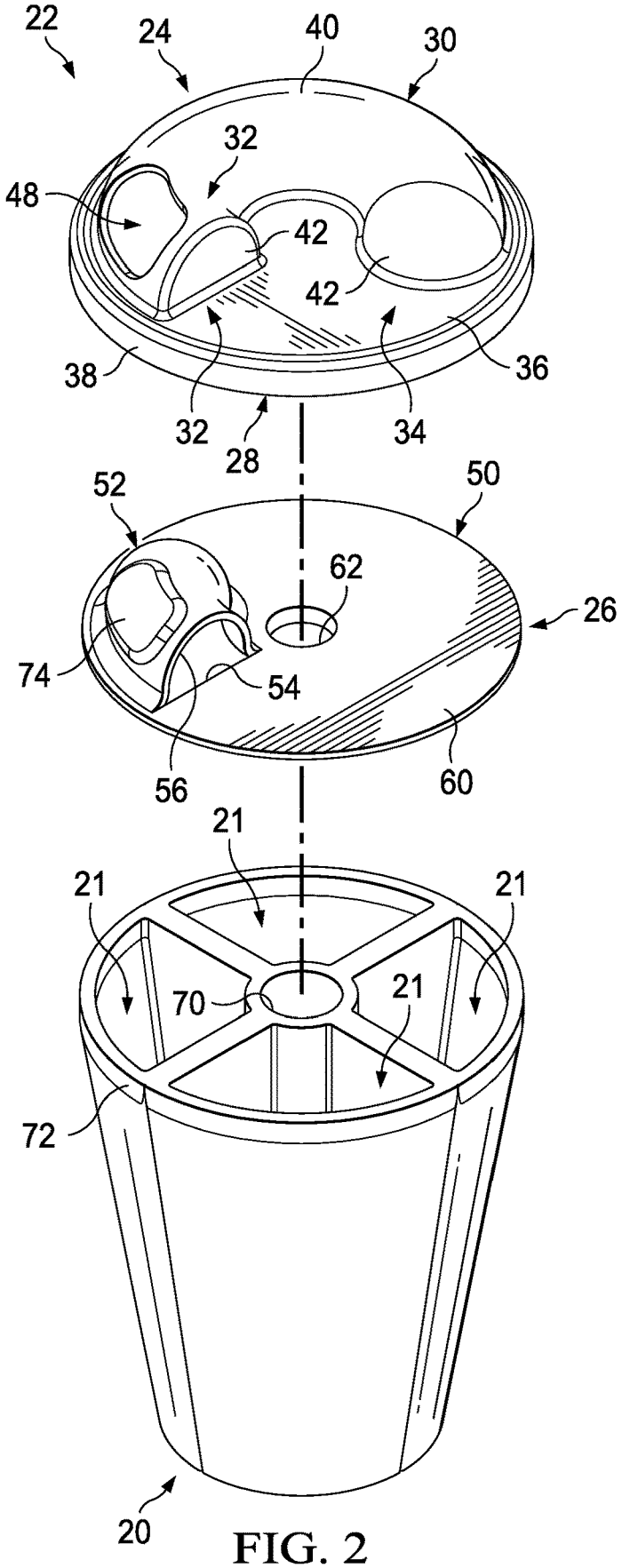
FIG. 2 is an isometric exploded view depicting the container and lid assembly of FIG. 1.

In connection with the views and examples of FIGS. 1-38, wherein like numbers indicate the same or corresponding elements throughout the views, FIGS. 1-2 illustrate a container 20 and a lid assembly 22. The container 20 can include a plurality of compartments 21 that are each configured to store a food product. Some examples of the various types of food products that can be stored in the container 20 can include, but are not limited to, snack foods (e.g., pretzels, crackers, nuts, dried fruit, cereal), candy (e.g., bubblegum, button shaped chocolates, breath mints), baking materials (e.g., sugar, chocolate chips, baking soda, baking powder), powdered drinks (e.g., a powered shake, powdered lemonade, powdered flavoring for water), pet treats/food (e.g., dog treats, cat treats, fish food), or any of a variety of other suitable food products that are capable of being distributed through the lid assembly 22.

As illustrated in FIG. 1, the lid assembly 22 can be selectively installed on the container 20 over the compartments 21. As will be described in further detail below, the lid assembly 22 can facilitate individual, selective dispensation of the food product from each of the compartments 21. As illustrated in FIG. 2, the lid assembly 22 can include an upper lid 24 and a lower lid 26. The upper lid 24 can include a base portion 28 and a containment portion 30 that extends along the base portion 28 between a first end 32 and a second end 34. The base portion 28 can comprise a central member 36 that is substantially disc-shaped and a flange 38 that extends from the central member 36. The containment portion 30 can include a main wall 40 and a pair of end walls 42 that extend from the central member 36 of the base portion 28 such that the overall height of the containment portion 30 is greater than the height of the base portion 28.

Figure 3:
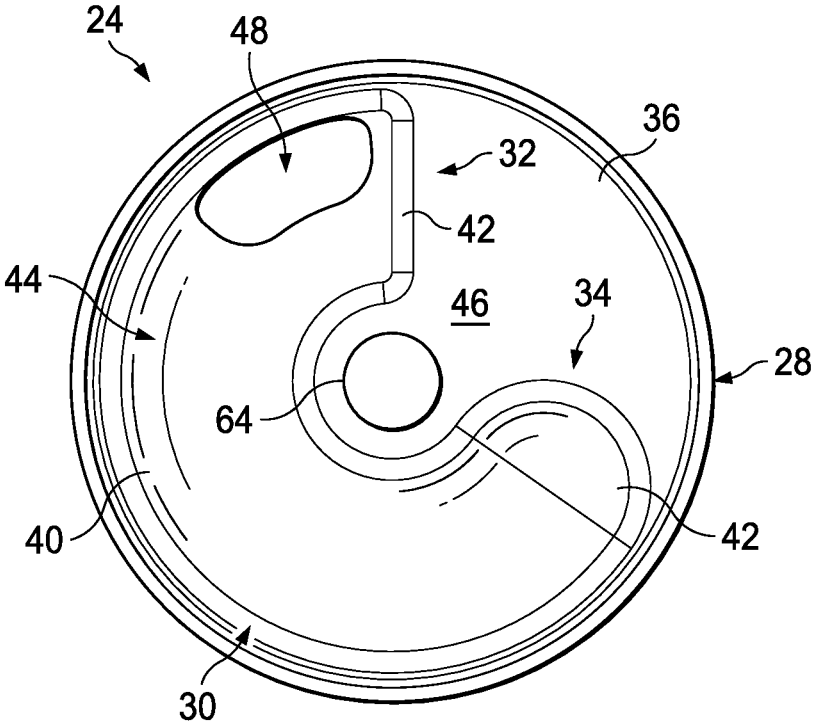
FIG. 3 is a lower plan view depicting an upper lid of the lid assembly of FIG. 1.

As illustrated in FIGS. 1 and 2, the main wall 40 can be substantially dome-shaped, the end wall 42 at the first end 32 can be substantially planar, and the end wall 42 at the second end 34 can be hemisphere-shaped. Referring now to FIG. 3, the main wall 40 and the end walls 42 can cooperate to define an elongated recess 44 that is exposed along a bottom surface 46 of the upper lid 24. The main wall 40 of the containment portion 30 can define a dispensation opening 48 (FIGS. 2 and 3) that is located at the first end 32 of the containment portion 30 and extends through the containment portion 30 to the elongated recess 44.

The containment portion 30 is shown to extend circumferentially and partially around the upper lid 24 such that the first end 32 and the second end 34 are spaced from each other. In another embodiment, the containment portion 30 can extend entirely around the upper lid 24 such that the containment portion 30 forms a ring around the upper lid 24.

Referring again to FIG. 2, the lower lid 26 can include a base portion 50 that is substantially disc-shaped and a divider 52 that extends from the base portion 50. The base portion 50 and the divider 52 can cooperate to define a lower opening 54. The divider 52 can be substantially hood-shaped and can substantially overlie the lower opening 54. The divider 52 can define a lateral opening 56 that is in fluid communication with the lower opening 54.

The upper lid 24 and the lower lid 26 can each be formed as a unitary one-piece construction. In one embodiment, the upper lid 24 and the lower lid 26 can be formed of a thermoplastic via extrusion, injection molding, thermoforming, blow molding, three dimensional printing, or any of a variety of other suitable alternative thermoplastic formation processes. In other embodiments, the upper lid 24 and/or the lower lid 26 can be formed of material other than thermoplastic, such as paperboard and/or metal, for example. In some embodiments, one or each of the upper lid 24 and the lower lid 26 might not be formed as individual unitary one-piece constructions but instead can be an assembly of discrete components.

Figure 5:
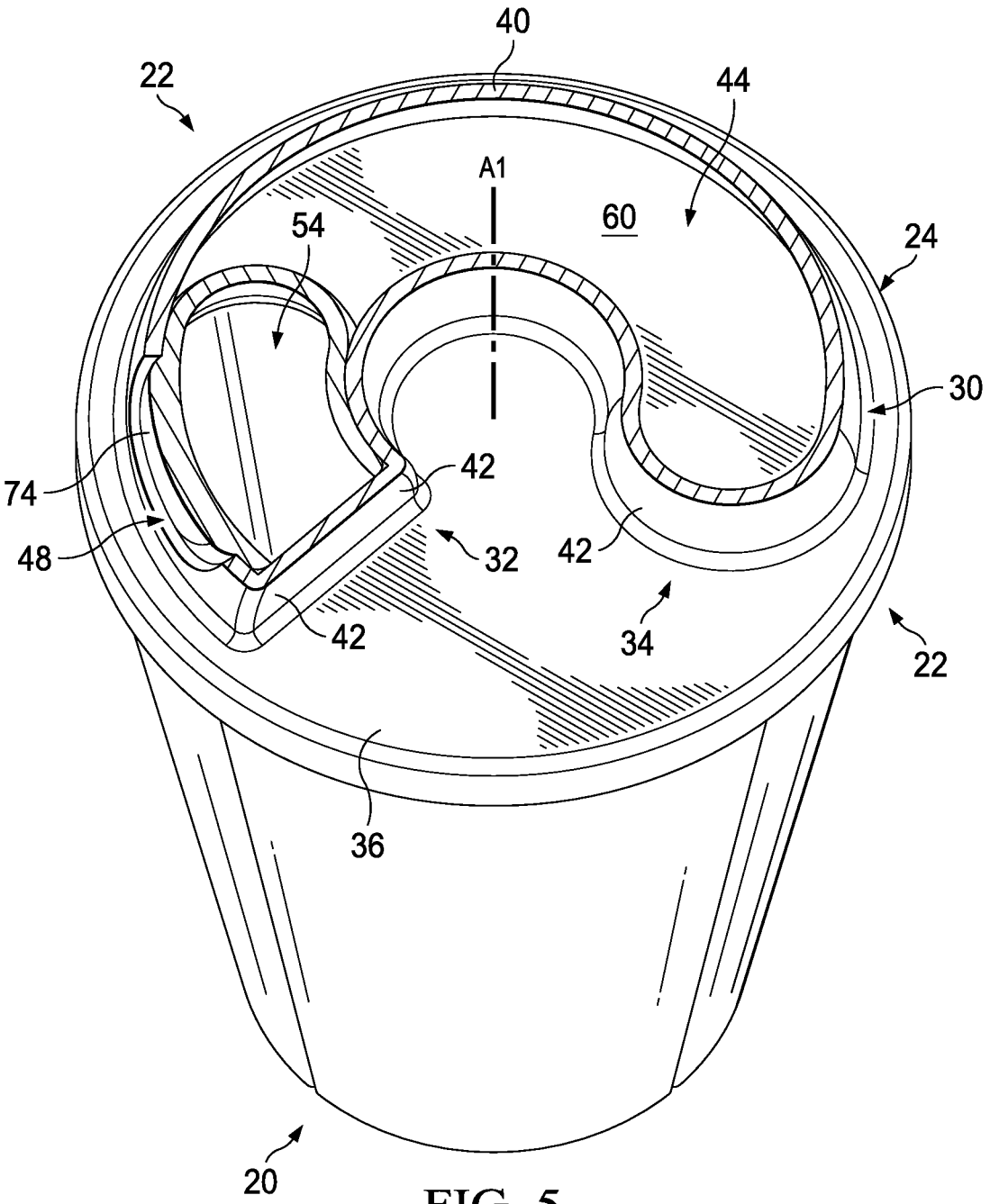
FIG. 5 is an isometric sectional view taken along the line 5-5 in FIG. 1 with the upper lid shown in a closed position.

The lower lid 26 can underlie the upper lid 24 and can be nested with the upper lid 24 such that the divider 52 extends into the elongated recess 44 (FIG. 3) and the flange 38 extends beyond the lower lid 26. The lower lid 26 can be pivotally coupled with the upper lid 24 such that the upper lid 24 is pivotable with respect to the lower lid 26 about an axis A1 (FIGS. 1 and 5). In one embodiment, as illustrated in FIG. 2, an upper surface 60 of the lower lid 26 can define a receptacle 62. As illustrated in FIG. 3, the upper lid 24 can include a projection 64 that extends from the bottom surface 46 of the central member 36. The projection 64 can be inserted into the receptacle 62 of the lower lid 26 (e.g., in a friction fit arrangement) to facilitate pivotal coupling of the upper lid 24 and the lower lid 26 together. The receptacle 62 and the projection 64 can be provided with complimentary retention features (not shown), such as a radial slot and radial rib, respectively, for example, that facilitate retention of the projection 64 within the receptacle 62 and allow for pivoting of the lower lid 26 with respect to the upper lid 24 while maintaining securement therebetween. When the upper lid 24 and lower lid 26 are pivotally coupled together in this manner, the divider 52 can be nested with the containment portion 30 such that the divider 52 is disposed within the elongated recess 44, and the lower opening 54 is in fluid communication with the elongated recess 44.

Figure 4:
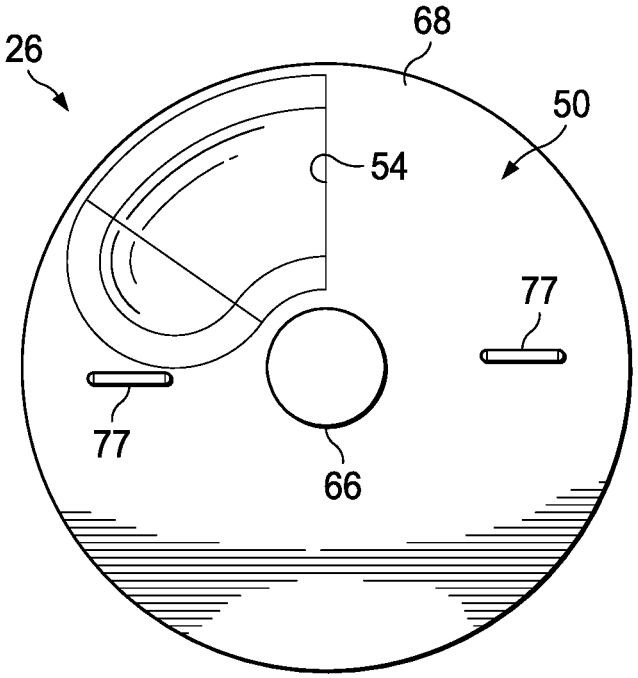
FIG. 4 is a lower plan view depicting a lower lid of the lid assembly of FIG. 1.

The lid assembly 22 can be rotatably coupled with the container 20. Referring now to FIG. 4, the lower lid 26 can include a projection 66 that extends from a bottom surface 68 of the lower lid 26 and is substantially aligned with the receptacle 62. As illustrated in FIG. 2, the container 20 can define a receptacle 70 that is located between the compartments 21. The projection 66 can be inserted into the receptacle 70 of the container 20 (e.g., in a friction fit arrangement) to facilitate rotatable coupling of the lid assembly 22 with the container 20. The receptacle 70 and the projection 66 can be provided with complimentary retention features (not shown), such as a radial slot and radial rib, respectively, for example, that facilitate retention of the projection 66 within the receptacle 70 and allow for rotation of the lid assembly 22 with respect to the container 20 while maintaining securement therebetween. The lid assembly 22 can be rotated with respect to the container 20 to position the lower opening 54 of the lower lid 26 over different ones of the compartments 21. As will be described in further detail below, when the compartments 21 are filled with different products, a user can select which of the different products is to be dispensed from the container 20 by rotating the lid assembly 22.

When the lid assembly 22 is rotatably coupled with the container 20, the flange 38 of the upper lid 24 can extend slightly beyond an upper edge 72 (FIG. 2) to prevent the food product in the compartments 21 from inadvertently escaping from the lid assembly 22. In one embodiment, the container 20 and the flange 38 can be provided with complimentary retention features (not shown), such as a radial slot and radial rib, respectively, for example, that provide supplemental or sole rotational coupling of the lid assembly 22 to the container 20.

Figure 6:
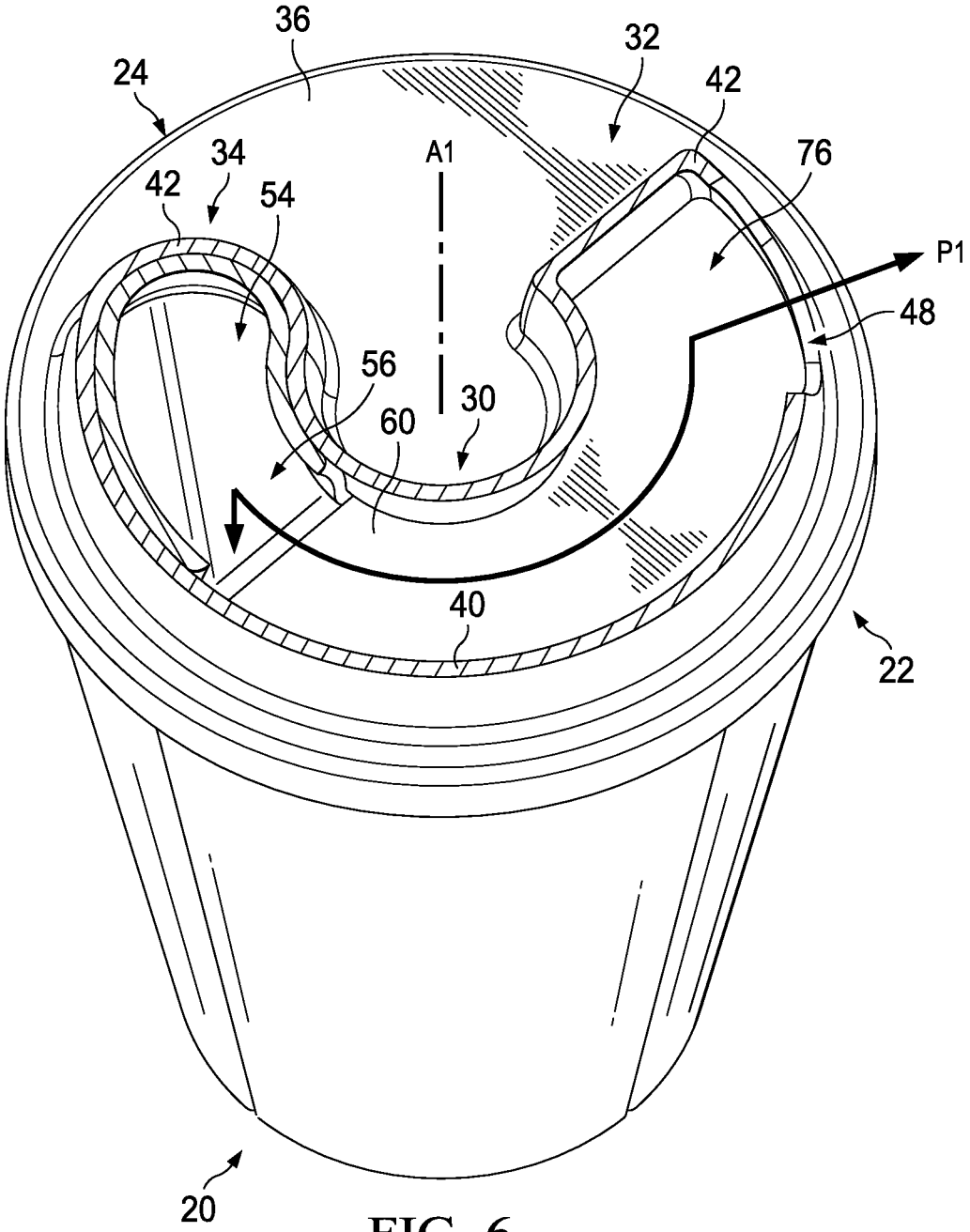
FIG. 6 is isometric sectional view that is similar to FIG. 5, but with the upper lid shown in a dispensation position.

Referring now to FIGS. 5 and 6, the upper lid 24 can be pivotable with respect to the lower lid 26 between a closed position (FIG. 5) and a dispensation position (FIG. 6). When the upper lid 24 is in the closed position, as illustrated in FIG. 5, the lower opening 54 can be proximate the dispensation opening 48. The end wall 42 at the first end 32 of the containment portion 30 can substantially cover the lateral opening 56 of the divider 52, and the divider 52 can substantially cover the dispensation opening 48. As such, any food product that is provided through the lower opening 54 can be contained within the divider 52 and thus prevented from being dispensed through the dispensation opening 48 or escaping into the rest of the elongated recess 44 (e.g., the portion of the elongated recess 44 that extends between the divider 52 and the second end 34 of the containment portion 30).

When the upper lid 24 is in the closed position, as illustrated in FIG. 5, a convex portion 74 of the divider 52 can extend into the dispensation opening 48 to facilitate selective retention of the upper lid 24 in the closed position. When the upper lid 24 is to be moved to the dispensation position, the convex portion 74 of the divider 52 can be pressed inwardly to move the convex portion 74 away from the dispensation opening 48 enough to allow the upper lid 24 to begin pivoting with respect to the lower lid 26. Once the dispensation opening 48 is no longer aligned with the convex portion 74, the convex portion 74 can be released and the upper lid 24 is free to pivot into the dispensation position. It is to be appreciated that the upper lid 24 can be selectively retained in the closed position with any of a variety of suitable alternative arrangements.

When the upper lid 24 is in the dispensation position, as illustrated in FIG. 6, the lower opening 54 can be spaced further from the dispensation opening 48 than when the upper lid 24 is in the closed position such that the upper lid 24 and the lower lid 26 cooperate to define a dispensation chamber 76 that extends between the first end 32 of the containment portion 30 and the divider 52 (FIG. 2). The dispensation chamber 76 can be defined by the containment portion 30, the divider 52, and a portion of the upper surface 60 of the base portion 50 (FIG. 2) that is now exposed beneath the containment portion 30 between the lower opening 54 and the first end 32 of the containment portion 30.

The lower lid 26 can accordingly cooperate with the containment portion 30 to define a tortuous dispensation path P1 through the upper lid 24 and the lower lid 26 for the contents of the container 20. The tortuous dispensation path P1 can extend through the dispensation opening 48, along the dispensation chamber 76 (e.g., along the elongated recess 44 between the containment portion 30), through the lower opening 54 and to the underlying compartment 21. It is to be appreciated that a path described herein as being tortuous can be understood to mean that the path is defined by a pair of openings on opposite ends that are spaced from each other and that the path changes direction at least once between the openings.

The dispensation chamber 76 and the tortuous dispensation path P1 can enable a user to control the amount of the food product that is dispensed from the container 20. For example, to dispense the food product from one of the compartments 21, the container 20 can initially be angled in such a manner to allow food product to be dispensed from the compartment 21, through the lower opening 54 and into the dispensation chamber 76 without allowing the contents to escape through the dispensation opening 48. In some instances, the container 20 can additionally be shaken, rolled, and/or dipped, especially when the food product is not particularly conducive to being easily poured, such as when the compartment 21 is filled with bulkier food items, such as hard candy pieces. Once a desired amount of the food product has been provided into the dispensation chamber 76, the container 20 can be repositioned in a manner that prevents further flow of the food product into the dispensation chamber 76 from the compartment 21 and simultaneously allows the food product in the dispensation chamber 76 to be dispensed through the dispensation opening 48. In some instances, the container 20 can additionally be shaken, rolled, and/or dipped to facilitate dispensation of the food product in the dispensation chamber 76 through the dispensation opening 48.

When the upper lid 24 is in the dispensation position, the location of the divider 52 relative to the first end 32 can affect the overall volume of the dispensation chamber 76. For example, the closer the divider 52 is to the first end 32, the smaller the volume of the dispensation chamber 76, and the further the divider 52 is from the first end 32, the larger the volume of the dispensation chamber 76. The volume of the dispensation chamber 76 can affect the amount of food product that is dispensed from the container 20 at a given time. The dispensation position of the upper lid 24 can accordingly be selected to select an amount of the food product that is to be dispensed from the container 20. This can enable a user to select the portion size of the food product being dispensed to the user.

The container 20 and the lid assembly 22 can accordingly facilitate user control of the amount of food product that is dispensed to the user at a given time, which can encourage portion control. For example, the user can select a dispensation position that enables a particular amount of food product to be dispensed from the container 20. Once the user dispenses the desired amount of food product from the container 20 a first time, the container 20 can be tilted, shaken, rolled, and/or dipped again to reload the food product into the lid assembly 22. Additionally, or alternatively, the lower lid 26 can be rotated to select another compartment 21 from which to dispense food product. Any of these deliberate actions might cause a user to reconsider whether to consume more of the food product. As a result, the user can be more cognizant of the amount of food product that is being consumed and might accordingly be less likely to overindulge than when the food product is dispensed from a conventional container arrangement such as a pour-spout arrangement, a box, or a bag. It is to be appreciated that such portion control can be utilized to aid in dieting.

The overall form factor of the container 20 and lid assembly 22 can be similar to many conventional cup and lid arrangements such that the container 20 and lid assembly 22 are easily portable and can thus be readily accessible to a user throughout the day. When a user is on a diet or predetermined eating plan, the user can readily dispense and consume discrete portions of food product from the container 20 and the lid assembly 22 as part of the diet or predetermined eating plan and/or to alleviate hunger. The user can thus be less likely to consume portions or food products that are not part of the diet or predetermined eating plan.

The container 20 and lid assembly 22 can also mitigate the likelihood of the food product in the container 20 becoming contaminated by a user as a result of dispensing the food product. For example, when the food product is dispensed from the container 20 and lid assembly 22 and to a user's hand, the size of the dispensation opening 48 can discourage the user from providing the dispensed food product back into the container 20, thereby alleviating the possibility that contaminants from the user's hand might be introduced into the container 20. In addition, the food product can be dispensed directly to a user's mouth from the container 20 which can alleviate the possibility that external contaminants (e.g., from the user's hand or from a germ friendly environment, such as a hospital waiting room) might be introduced to the food product.

In one embodiment, the upper lid 24 and/or the lower lid 26 can be provided with features, such as detents, for example (not shown), that guide the upper lid 24 into preselected dispensation positions with respect to the lower lid 26. Each preselected position can correlate to a different measured amount of food product. In one embodiment, each position can correlate to a different imperial volume (e.g., ⅛ cup, ¼ cup, ⅓ cup and ½ cup) to facilitate dispensation of measured amounts of food product from the container 20, which can be useful, for example, in portion control and baking.

In one embodiment, one or more of the compartments 21 can be filled with different types of food products. In such an embodiment, the lid assembly 22 can be rotated with respect to the container 20 to facilitate selection and dispensation of the food product stored in one of the compartments 21. In particular, the lid assembly 22 can be rotated to align the lower opening 54 with the compartment 21 that is of interest to a user. When the lower lid 26 is in the dispensation position and the container 20 is tilted and/or shaken, the product in the compartment 21 associated with the lower opening 54 can be dispensed through the lid assembly 22 while the base portion 50 of the lower lid 26 can block the other compartments 21.

In one embodiment, as illustrated in FIG. 4, the lower lid 26 can include a pair of tab members 77 that are disposed on the bottom surface 68 and configured to interact with the container 20 to resist or prevent the lower lid 26 from rotating when the upper lid 24 is rotated between the closed position and the dispensation position. In such an embodiment, a user can rotate the lid assembly 22 by first lifting the flange 38 of the upper lid 24 to flex the lid assembly 22 upwardly. Once the tab members 77 are clear of the container 20, the lid assembly 22 can be rotated into a desired position. When the lid assembly 22 is released, the tab members 77 can again project into the container 20 to resist or prevent the lower lid 26 from rotating when the upper lid 24 is rotated between the closed and dispensation positions.

The container 20 and the lid assembly 22 can include cooperating indicia (not shown) that identifies which position of the lid assembly 22 enables dispensation of food product from each compartment 21. For example, each of the compartments 21 can be provided with an external identifier located on an exterior of the compartment 21 such as a number or the name of the food product stored in the compartment 21. The lid assembly 22 can also include an identifier, such as an arrow or a line which, when aligned with the compartment 21 desired by the user (with the upper lid 24 in the closed position), aligns the lower opening 54 over that compartment 21 to facilitate dispensation of the desired food product therefrom. In one embodiment, the container 20 and/or the lid assembly 22 can be provided with features, such as detents, for example (not shown), that guide the lid assembly 22 into preselected positions with respect to the container 20. Each preselected position can position the lower opening 54 over one of the compartments 21.

In one embodiment, the container 20 and lid assembly 22 can be provided as a consumer packaged good that is pre-packaged with food product(s) by a manufacturer and distributed to consumers through conventional commercial channels (e.g., at a store). In such an embodiment, the container 20 and/or the lid assembly 22 can be provided with a label or other indicia that identifies the food product(s) stored in the container 20, the nutritional information for the product(s), an approximation of the amount of product(s) that can be dispensed from the containment portion 30 of the lid assembly 22 at one time, and/or any of a variety of other suitable indicia that may be of interest to a user. Such a label can be shrink wrapped around the container 20, applied directly to the container 20 (e.g., via inkjet printing) or provided on the container 20 in any of a variety of suitable alternative manners. In another embodiment, the container 20 and the lid assembly 22 can be reusable such that a user can fill the compartments 21 with desired product(s) for subsequent dispensation therefrom. In such an embodiment, each of the compartments 21 can be provided with a plurality of fill lines or other indicia that facilitate measurement of the food product that is provided in the compartment 21.

An example of the container 20 and lid assembly 22 in use will now be described. In such an example, the lower lid 26 of the lid assembly 22 can first be provided in the closed position such that the lid assembly 22 is effectively closed. When a user wants to dispense a food product from the container 20, the user can rotate the lid assembly 22 to the position that correlates to the compartment 21 from which the user wants to receive food product. Once the lid assembly 22 is in position, the user can depress the convex portion 74 of the divider 52 away from the dispensation opening 48 and can pivot the upper lid 24 into a desired dispensation position. The user can then tilt, shake, roll and/or dip the container 20 to dispense the food product from the selected compartment 21 without causing any food product to yet be dispensed from the dispensation opening 48. If the amount of food product dispensed into the dispensation chamber 76 is not the amount the user desired, the user can then tilt, shake, roll and/or dip the container 20 to return the food product back to the compartment 21 and can adjust the dispensation position of the upper lid 24. The user can repeat this process until the correct amount of food product is dispensed into the dispensation chamber 76. Once the correct amount of food product is dispensed into the dispensation chamber 76, the user can then tilt, shake, roll and/or dip the container 20 to cause the food product in the dispensation chamber 76 to be dispensed out of the dispensation opening 48 and to a user's hand or mouth. The user can repeat this process until a desired amount of the food product has been dispensed to the user. If the user then desires to have a different food product dispensed from the container 20, the user can rotate the lid assembly 22 into a different position to select food product from one of the other compartments 21 and can follow the steps to dispense product from the container 20 described above. Once the user is finished dispensing food product(s) from the container 20, the user can pivot the upper lid 24 back to the closed position to effectively close the container 20 such that food product does not inadvertently escape from the container 20 during transportation.

Although the container 20 and the lid assembly 22 are described for use with food products, it is to be appreciated that the container 20 can be filled with any of a variety of suitable alternative products that are capable of being dispensed through the lid assembly 22. In one embodiment, the container 20 can be filled with hardware, such as nuts and bolts, for example. In such an embodiment, the dispensation position of the upper lid 24 of the lid assembly 22 can be selected to facilitate dispensation of an approximate desired amount of hardware from the container 20. This can allow for more precise dispensation of hardware to a user than with conventional arrangements. In other embodiments, the container 20 can be filled with other suitable types of material such as buttons, crafting supplies, electrical components, or any of a variety of other suitable materials that are capable of being dispensed from the lid assembly 22.

Figure 7:
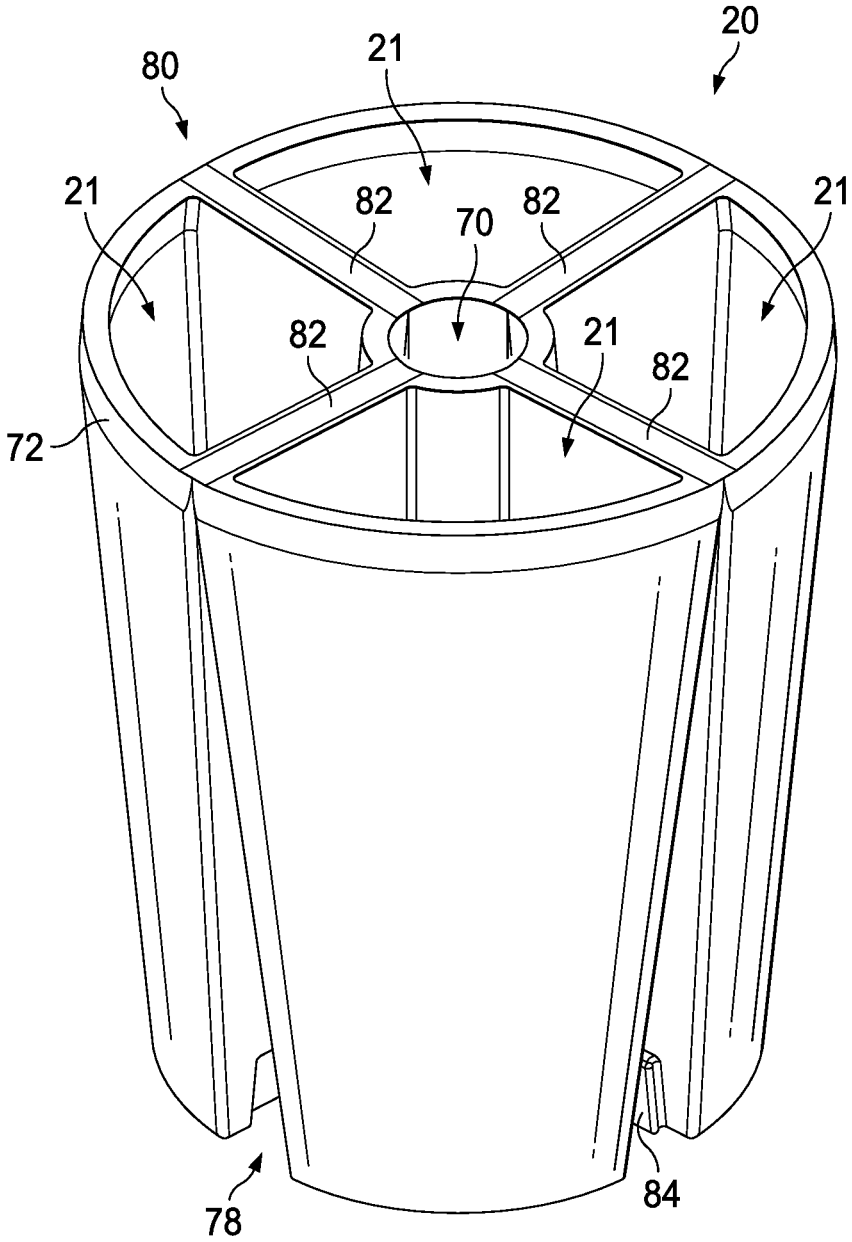
FIG. 7 is an isometric view depicting the container of FIG. 1 in a stackable configuration.

Referring now to FIGS. 2 and 7-10, the configuration of the container 20 will now be described. As illustrated in FIG. 7, each of the compartments 21 can be coupled to an adjacent compartment (e.g., 21) at an upper portion 80 of the container 20 and can be selectively spaced apart from each other at a bottom portion 78 of the container 20. Each of the compartments 21 can be coupled together at the upper portion 80 of the container 20 by a cross-web member 82, which in some embodiments can comprise a living hinge. It is to be appreciated that the compartments 21 can be coupled together at the upper portion 80 of the container 20 with any of a variety of suitable alternative attachment arrangements.

Figure 8:
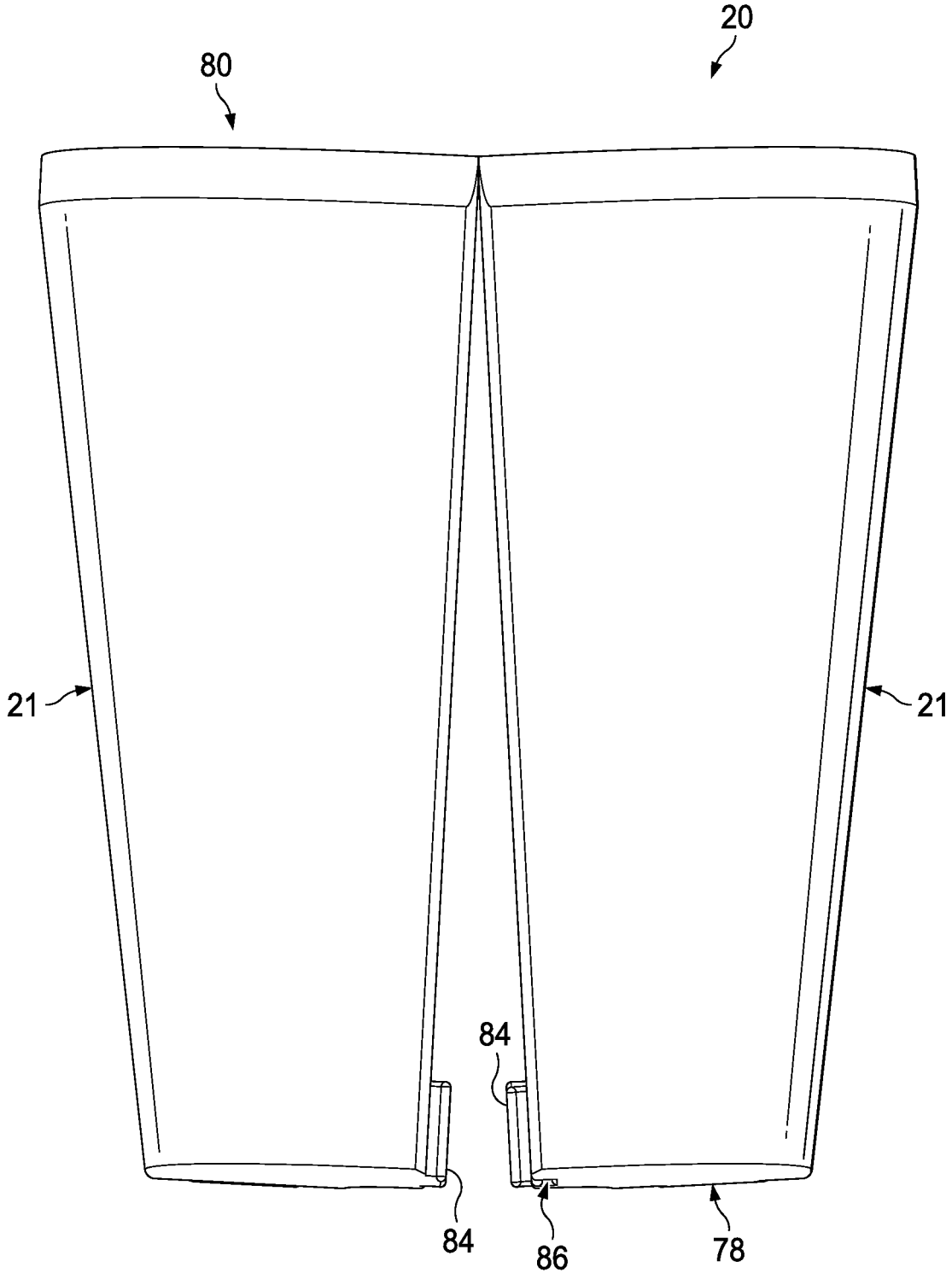
FIG. 8 is a side plan view depicting the container of FIG. 7.
Figure 9:
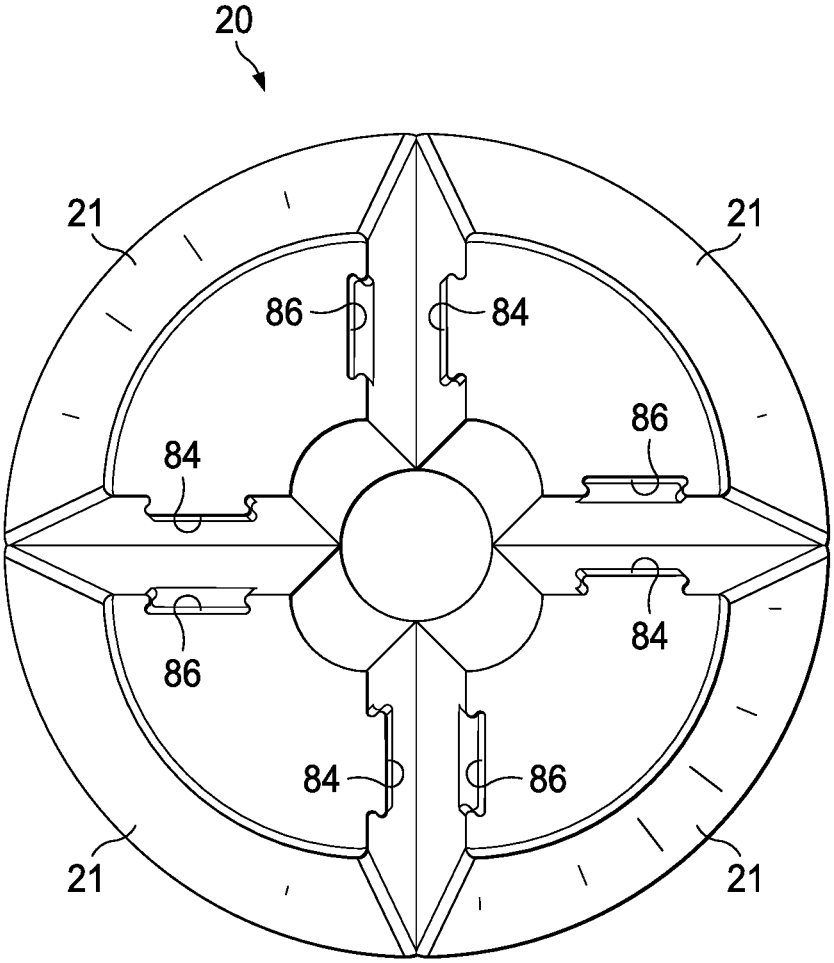
FIG. 9 is a lower plan view depicting the container of FIG. 7.
Figure 10:
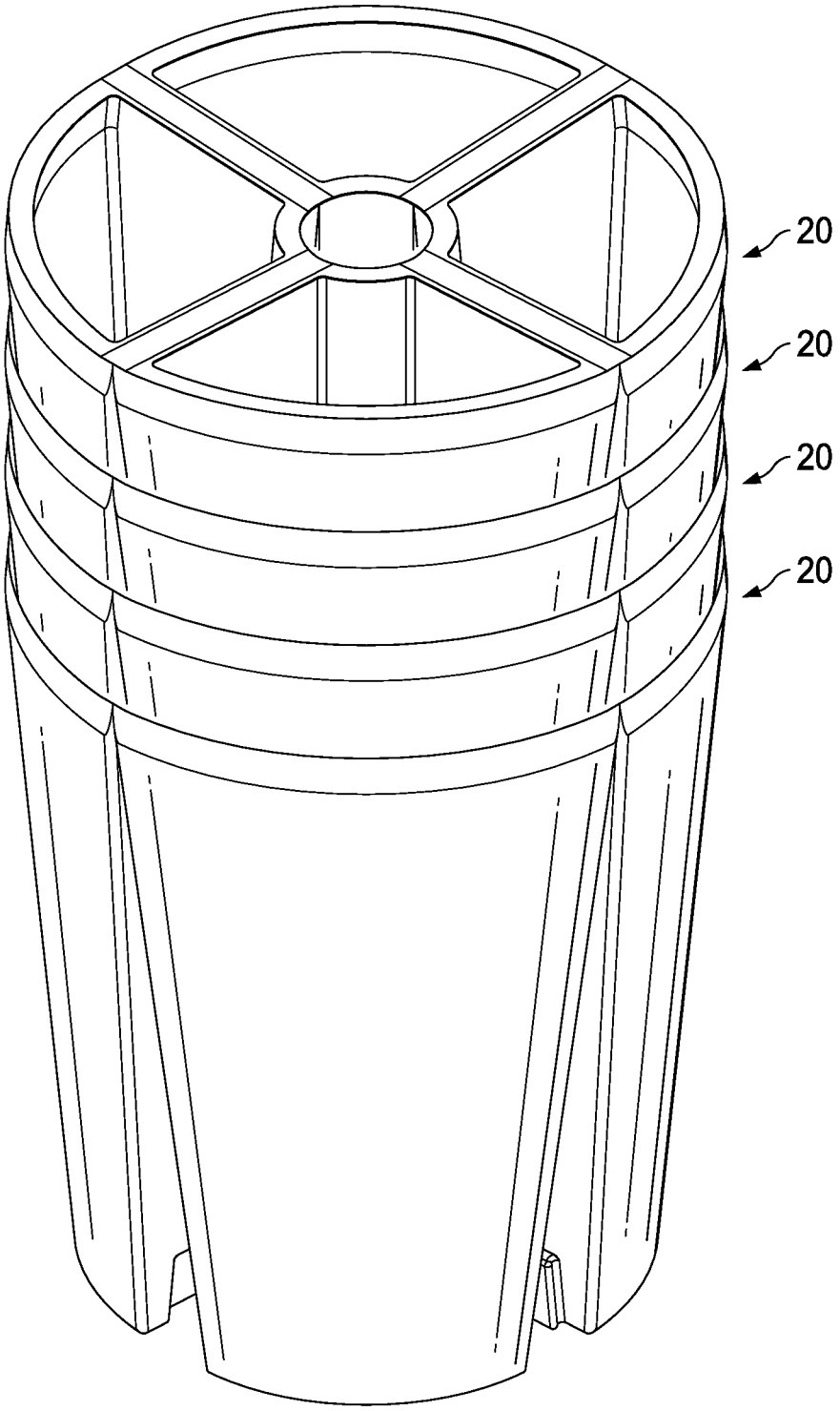
FIG. 10 is an isometric view depicting a stacked arrangement of containers, wherein each container is substantially identical to the container illustrated in FIGS. 7-9.

As illustrated in FIGS. 2 and 7-9, the container 20 can be selectively configured in either an assembled configuration (FIG. 2) or a stackable configuration (FIGS. 7-9). When the container 20 is in the assembled configuration, as illustrated in FIG. 2, each of the compartments 21 can be secured to each other at the bottom portion 78 of the container 20. When the container 20 is in the stackable configuration, as illustrated in FIGS. 7-9, each of the compartments 21 can be spaced from each other at the bottom portion 78 of the container 20. When the container 20 is in the stackable configuration, multiple containers (e.g., 20) can be stacked on one another, as illustrated in FIG. 10, to facilitate effective shipping and/or storage of the containers 20.

Referring now to FIGS. 7-9, each of the compartments 21 can include a locking tab 84 disposed at the bottom portion 78 of the container 20 and an exterior of the compartment 21. Each locking tab 84 can correspond with a receptacle 86 of an adjacent compartment 21. Each of the locking tabs 84 can engage with one of the receptacles 86 in a friction-fit type arrangement to facilitate releasable securement of the compartments 21 to one another. For example, when the container 20 is in the assembled configuration, each of the locking tabs 84 are engaged with one of the receptacles 86. To separate the compartments 21 at the bottom portion 78 of the container 20 (e.g., to place the container 20 in a stackable configuration), the compartments 21 can be pulled away from each other with enough force to overcome the interaction between the locking tabs 84 and the receptacles 86. When the container 20 is in the stackable configuration, the compartments 21 can be coupled together at the bottom portion 78 of the container 20 (e.g., to place the container 20 in the assembled configuration) by pushing the compartments 21 together with enough force to urge the locking tabs 84 into engagement with the receptacles 86. It is to be appreciated that the compartments 21 can be provided with any of a variety of suitable alternative complimentary retention features that facilitate releasable coupling of the compartments 21 together. In one embodiment, a sleeve (not shown) can be installed around the container 20, in addition to or in lieu of the locking tabs 84 and the receptacles 86, that can be gathered around the container 20 (e.g., via heat shrinking) to hold the compartments 21 together such that the container 20 is in the assembled configuration.

The container 20 can be formed as a unitary one-piece construction. In one embodiment, the container 20 can be formed of a thermoplastic via extrusion, thermoforming, injection molding, blow molding, three dimensional printing, or any of a variety of other suitable alternative thermoplastic formation processes. In other embodiments, the container 20 can be formed of material other than thermoplastic, such as paperboard or metal, for example. In some embodiments, the compartments 21 might not be formed as a unitary one-piece construction but instead can be an assembly of discrete components that are selectively secured together with locking tabs (e.g., 84) or other locking features. While the container 20 is shown to include four compartments 21, it is to be appreciated that a container can alternatively include as few as one compartment (e.g., a cup), or more than four compartments.

In one embodiment, the container 20 and lid assembly 22 can be configured as a disposable arrangement (e.g., a single-use arrangement that is typically disposed of after one use). In such an embodiment, the materials and overall construction of the container 20 and the lid assembly 22 can be selected to encourage ready disposal of the container 20 and lid assembly 22 (e.g., lightweight, inexpensive, deformable, environmental friendly). In another embodiment, the container 20 and the lid assembly 22 can be configured as a reusable arrangement such that the container 20 can be repeatedly refilled by a user and used in conjunction with the lid assembly 22. In such an embodiment, the materials and overall construction of the container 20 and the lid assembly 22 can be selected to be durable enough to allow for reuse of the container 20 and lid assembly 22. In yet another embodiment, the lid assembly 22 can be configured as a reusable lid assembly that can be repeatedly attached to different containers (e.g., 20). In such an embodiment, the containers (e.g., 20) can be configured as disposable containers.

Figure 11:
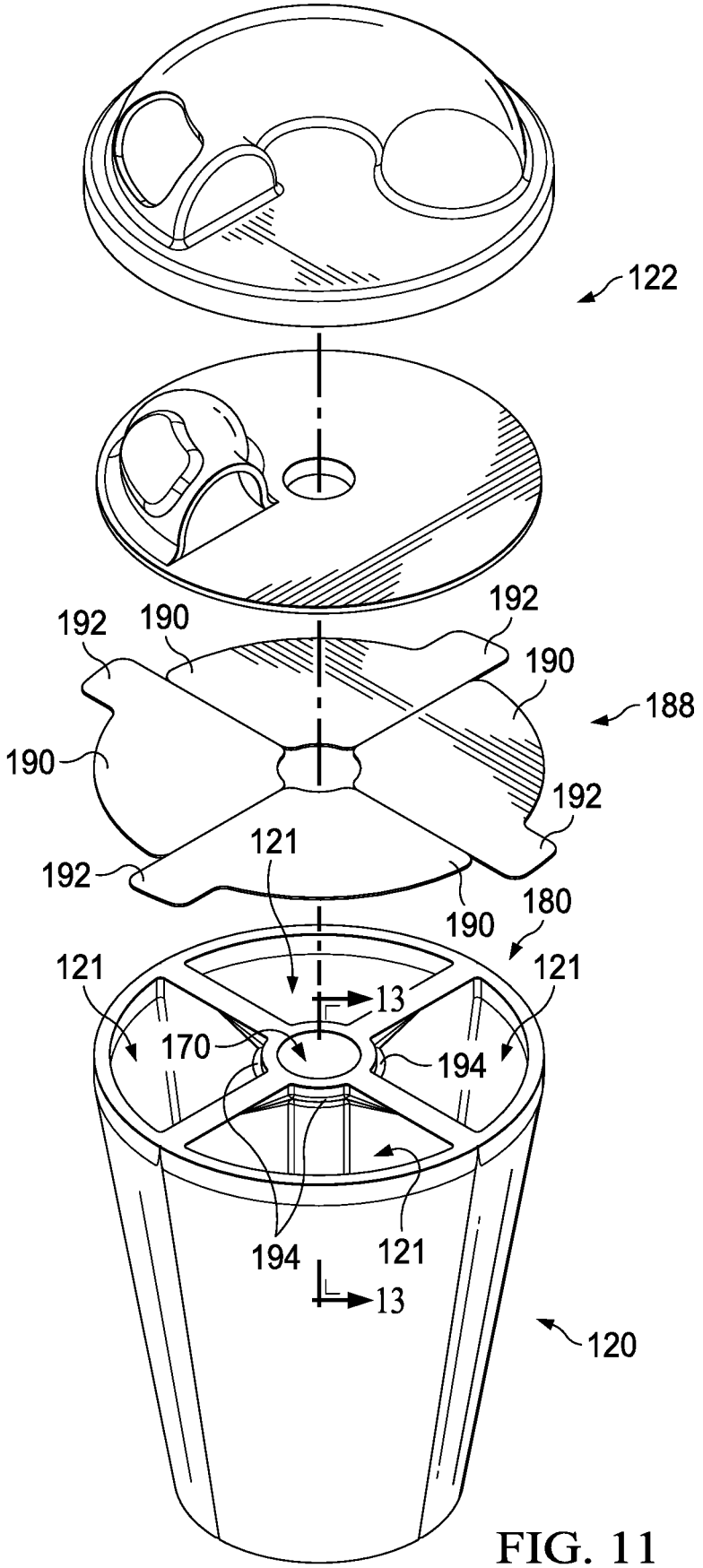
FIG. 11 is an exploded isometric view depicting a container in association with a lid assembly and a sealing arrangement, in accordance with another embodiment.
Figure 12:
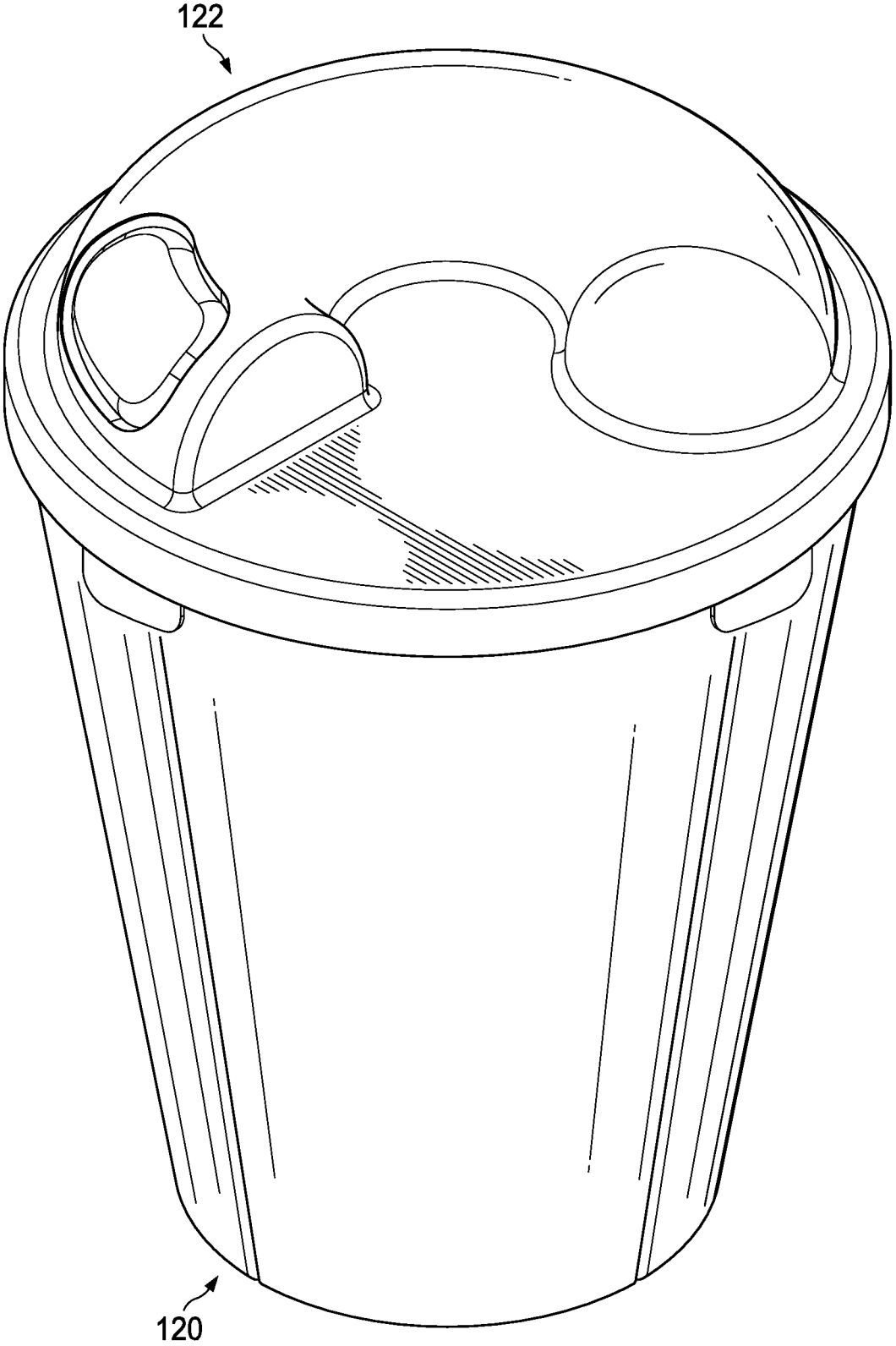
FIG. 12 is an assembled upper isometric view depicting the container, the lid assembly, and the sealing arrangement of FIG. 11.

FIGS. 11-14 illustrate an alternative embodiment of a container 120 and lid assembly 122 that is similar to, or the same in many respects as, the container 20 and lid assembly 22, respectively, illustrated in FIGS. 1-10. For example, the container 120 can include a plurality of compartments 121. However, as illustrated in FIG. 11, a sealing arrangement 188 is shown to be disposed over the compartments 121 to seal the compartments 121 from the outside environment. The sealing arrangement 188 can comprise a substrate that is configured for selective removal from the container 120. The sealing arrangement 188 can be formed of foil, thermoplastic or any of a variety of suitable alternative sealing materials.

As illustrated in FIG. 11, the sealing arrangement 188 can include a plurality of sealing portions 190 that each correspond to a respective one of the compartments 121. The sealing arrangement 188 can be formed of a unitary substrate with perforations, score lines, or other suitable frangible intersections that allow each of the sealing portions 190 to be selectively separated from adjacent ones of the sealing portions 190 such that each of the sealing portions 190 can be individually removed from the container 120 without disturbing adjacent ones of the sealing portions 190. As such, a user can remove only the sealing portions 190 from the compartments 121 the user wishes to gain access to, while leaving the other sealing portions 190 intact. Each of the sealing portions 190 can include a pull-tab member 192 that extends beyond the container 120 and can be grasped by a user to facilitate removal of the sealing portion 190 from the container 120. In one embodiment, each of the pull-tab members 192 can include indicia that identifies the food product that is stored in the compartment 121 associated with the associated sealing portion 190. It is to be appreciated that each of the sealing portions 190 can be attached (e.g., glued or heat pressed) to an outside perimeter of the container 120 as well as along an intersection of the compartments 121 to create an effective independent seal (e.g., a hermetic seal) between each sealing portion 190 and the underlying compartment 121. As such, when one of the sealing portions 190 is removed, the sealing of the adjacent sealing portions 190 is not disturbed. Although the pull-tab members 192 are shown on an outer perimeter of the sealing arrangement 188, it is to be appreciated that the pull-tab members 192 can additionally or alternatively be located on an interior perimeter of the sealing arrangement 188 and/or along a surface of the sealing portions 190.

In one embodiment, when the container 120 is a disposable container, the sealing arrangement 188 can be affixed to the container 120 as part of the manufacturing process. In another embodiment, when the container 120 is reusable, a plurality of the sealing arrangements 188 can be provided for individual use with the container 120. In such an embodiment, each time the container 120 is refilled, a new sealing arrangement (e.g., 188) can be affixed over the container 120 to effectively seal the newly added contents within the compartments 121. The sealing arrangements (e.g., 188) can have an adhesive layer (not shown) or other sealing material that facilitates attachment of the sealing arrangement 188 to the outer perimeter of the container 120 and to the intersection of the compartments 121. The sealing arrangements (e.g., 188) can be provided on a backing layer, which can be selectively removed to expose the adhesive layer. In some embodiments, a plurality of sealing arrangements (e.g., 188) can be provided on a sheet or a roll that allows a user to peel individual ones of the sealing arrangements (e.g., 188) from the backing layer for attachment to the container 120.

Figure 13:
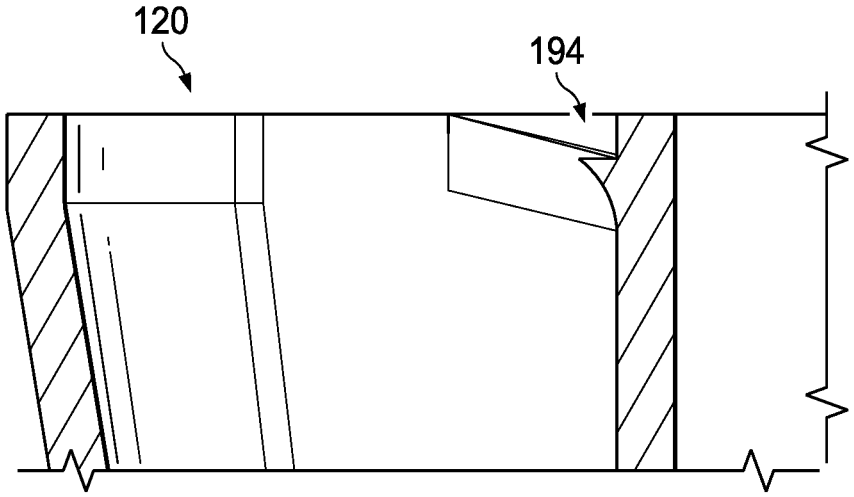
FIG. 13 is a sectional view taken along the lines 13-13 in FIG. 11.

Referring now to FIGS. 11 and 13, each of the compartments 121 can include a deformation feature 194 that is disposed adjacent to a receptacle 170 at an upper portion 180 of the container 120. The deformation feature 194 can be configured to relieve stress from the rest of the container 120 when the compartments 121 are secured together into an assembled configuration as described above with respect to the container 20. The deformation feature 194 can also be configured to relieve stress from the rest of the container 120 when the lid assembly 122 is installed on the container 120 (e.g., when a projection (e.g., 66) of the lower lid 126 is inserted into the receptacle 170. In one embodiment, as illustrated in FIG. 13, the deformation feature 194 can comprise a groove. However, it is to be appreciated that any of a variety of other suitable alternative stress relief features can be implemented. For example, in one embodiment, the container (e.g., 120) might include a central projection that mates with a receptacle on the lower lid (e.g., 126). In another embodiment, a container (e.g., 120) and a lower lid (e.g., 126) might not include a complementary central projection/receptacle arrangement, but might include some other retention arrangement that facilitates rotatable coupling between the container and the lid assembly.

Figure 14:
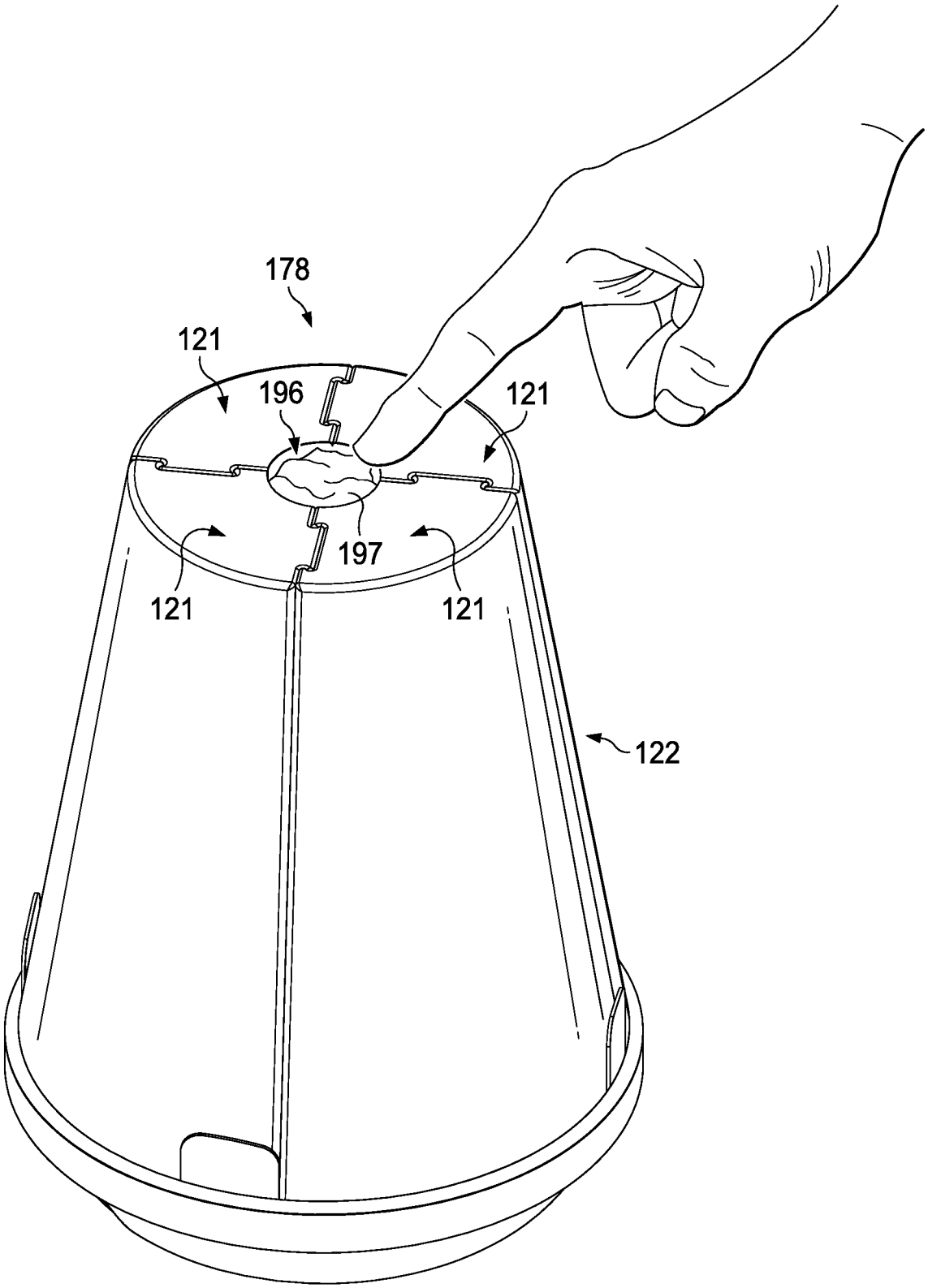
FIG. 14 is an assembled lower isometric view depicting the container, the lid assembly, and the sealing arrangement of FIG. 11 and further depicting disposable material being inserted into a central storage receptacle.

Referring now to FIG. 14, each of the compartments 121 can cooperate to define a central storage receptacle 196 that is located along a bottom portion 178 of the container 120 at the intersection of the compartments 121. In one embodiment, as illustrated in FIG. 14, the central storage receptacle 196 can serve as an onboard trash receptacle for disposable material 197. The disposable material 197 can be, for example, the sealing portions 190 or tamper evident shrink wrap (not shown) that are removed from the container 120 during use. For example, when a user removes the disposable material 197 from the container 120, the user can reach beneath the container 120 and push the disposable material 197 (e.g., with a finger) into the central storage receptacle 196 such that the disposable material 197 is contained within the central storage receptacle 196. The central storage receptacle 196 can therefore provide a convenient location to dispose of the disposable material 197 when a trash can or other suitable disposal location is not available. It is to be appreciated, that the central storage receptacle 196 can provide onboard storage for any of a variety of other suitable additional or alternative items. For example, flavor packets (e.g., salt or pepper) can be stored in the central storage receptacle 196 and selectively withdrawn from the central storage receptacle 196 to allow a user to selectively dispense the contents of the flavor packets to one or more of the compartments 121.

Figure 15:
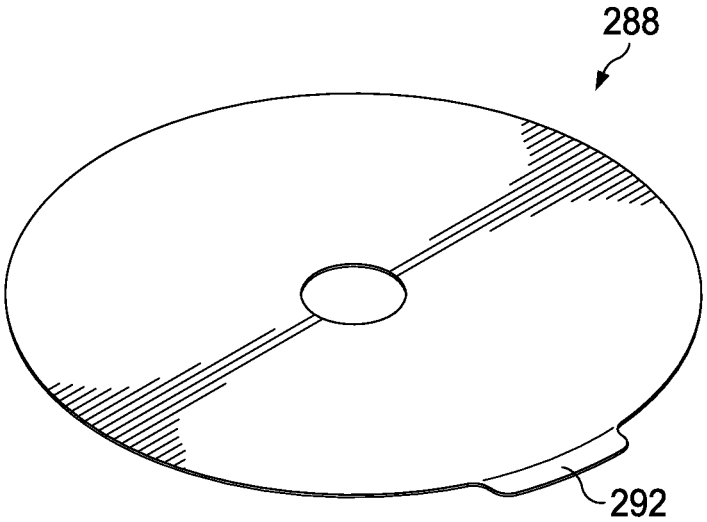
FIG. 15 is an isometric view depicting a sealing arrangement, in accordance with another embodiment.

FIG. 15 illustrates an alternative embodiment of a sealing arrangement 288 that is similar to, or the same in many respects as, the sealing arrangement 188, illustrated in FIGS. 11-14. However, the sealing arrangement 288 might not include individual sealing portions (e.g., 190) but instead can comprise a unitary substrate that can be removed all at once from the container (e.g., 20, 120) by a pull-tab member 292 to facilitate simultaneous access to all of the compartments (e.g., 21, 121). It is to be appreciated that the sealing arrangement 288 can be attached (e.g., glued or heat pressed) to an outside perimeter of the container (e.g., 20, 120) and/or along the intersection of the compartments (e.g., 21, 121) to create an effective seal therebetween.

Figure 16:
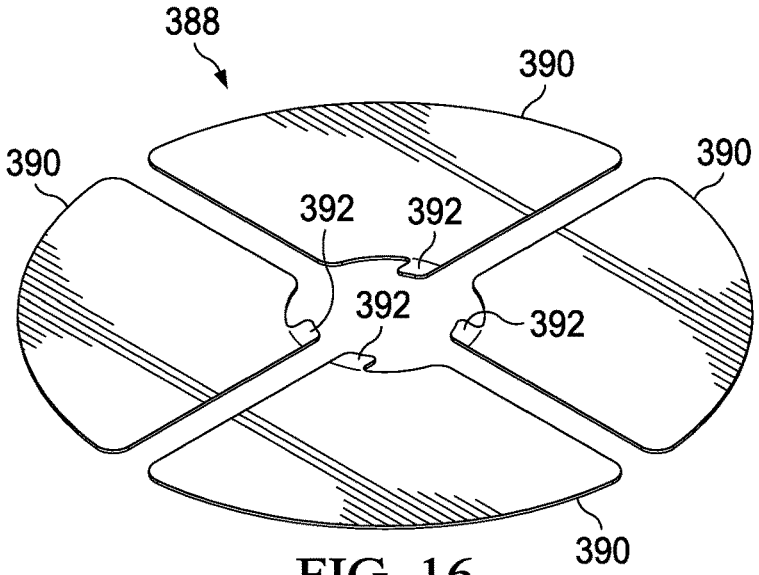
FIG. 16 is an isometric view depicting a sealing arrangement, in accordance with yet another embodiment.

FIG. 16 illustrates an alternative embodiment of a sealing arrangement 388 that is similar to, or the same in many respects as, the sealing arrangement 188, illustrated in FIGS. 11-14. For example, the sealing arrangement 388 can include a plurality of sealing portions 390. However, each of the sealing portions 390 can be separate from each other (i.e., the sealing arrangement 388 is discontinuous). Each of the sealing portions 390 can include a pull-tab member 392 that is disposed along an interior edge (e.g., adjacent to the receptacle (e.g., 170)) and can be grasped by a user to facilitate selective independent removal of each sealing portion 390 from the container (e.g., 20, 120). It is to be appreciated that each sealing portion 390 can be individually attached (e.g., glued or heat pressed) to the container (e.g., 20, 120) (e.g., to an outside perimeter and along the intersection of the underlying compartment (e.g., 21, 121)) to create an effective seal therebetween.

Figure 17:
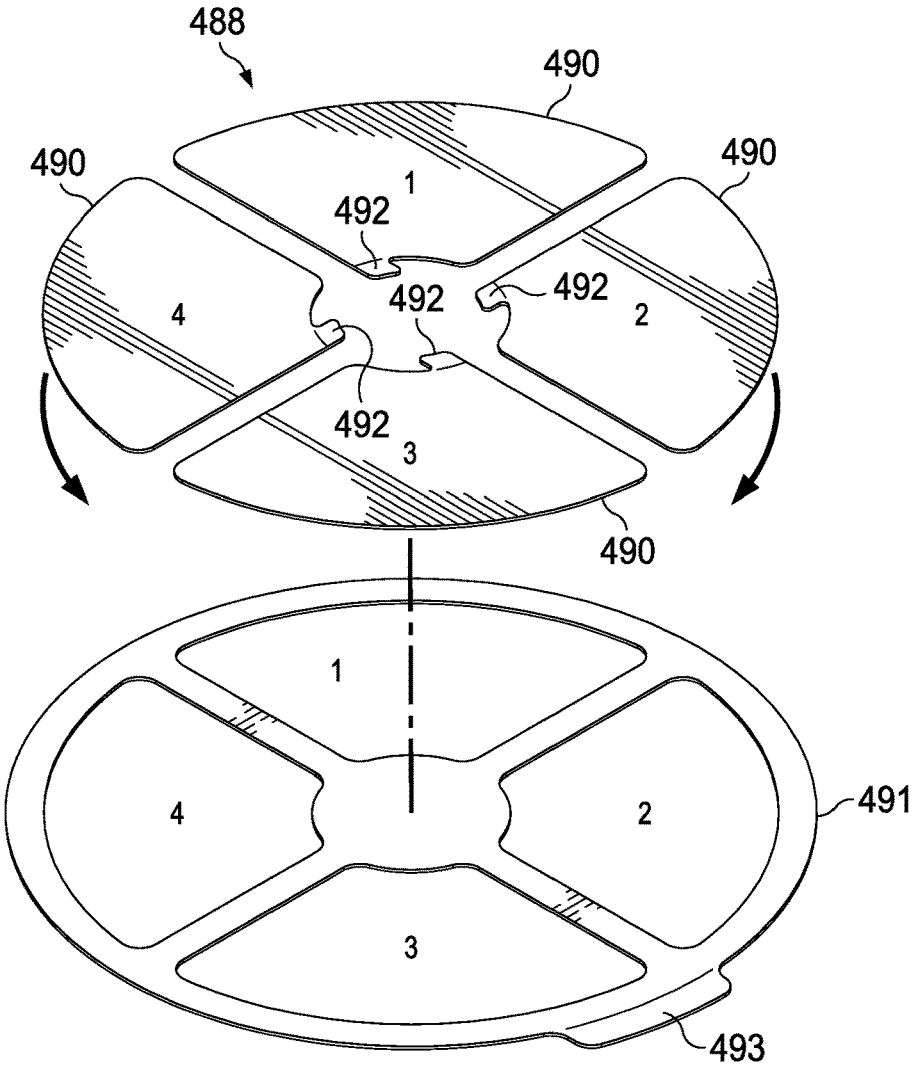
FIG. 17 is an isometric view depicting a sealing arrangement, in accordance with still yet another embodiment.

FIG. 17 illustrates an alternative embodiment of a sealing arrangement 488 that is similar to, or the same in many respects as, the sealing arrangement 188, illustrated in FIGS. 11-14. For example, the sealing arrangement 488 can include a plurality of sealing portions 490. However, the sealing arrangement 488 can have a common seal 491 that underlies the sealing portions 490. The common seal 491 can be attached (e.g., glued or heat pressed) to an outside perimeter of the container (e.g., 20, 120) and attached along the intersection of the compartments (e.g., 21, 121) to create an effective seal therebetween. Each of the sealing portions 490 can be attached (e.g., glued or heat pressed) to the common seal 491 to create an effective seal therebetween. Each of the sealing portions 490 can include a pull-tab member 492 that is disposed along an interior edge (e.g., adjacent to the receptacle (e.g., 170)) and can be grasped by a user to facilitate selective independent removal of each sealing portion 490 from the common seal 491. The common seal 491 can also have a pull-tab member 493 that can be grasped by a user to facilitate removal of the common seal 491 as well as any sealing portions 490 disposed thereon to facilitate simultaneous access to all of the compartments (e.g., 21, 121) of the container (e.g., 20, 120).

Figure 18:
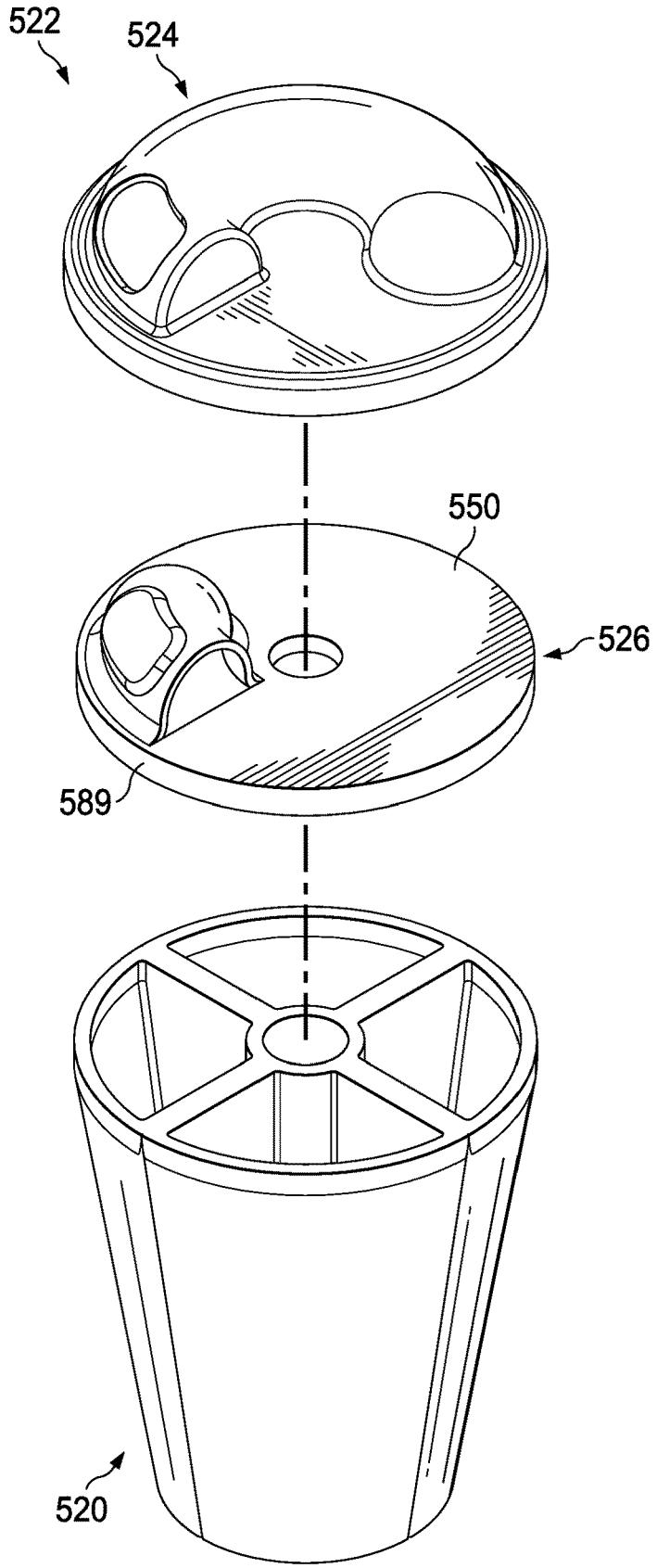
FIG. 18 is an exploded isometric view depicting a container in association with a lid assembly, in accordance with yet another embodiment.
Figure 19:
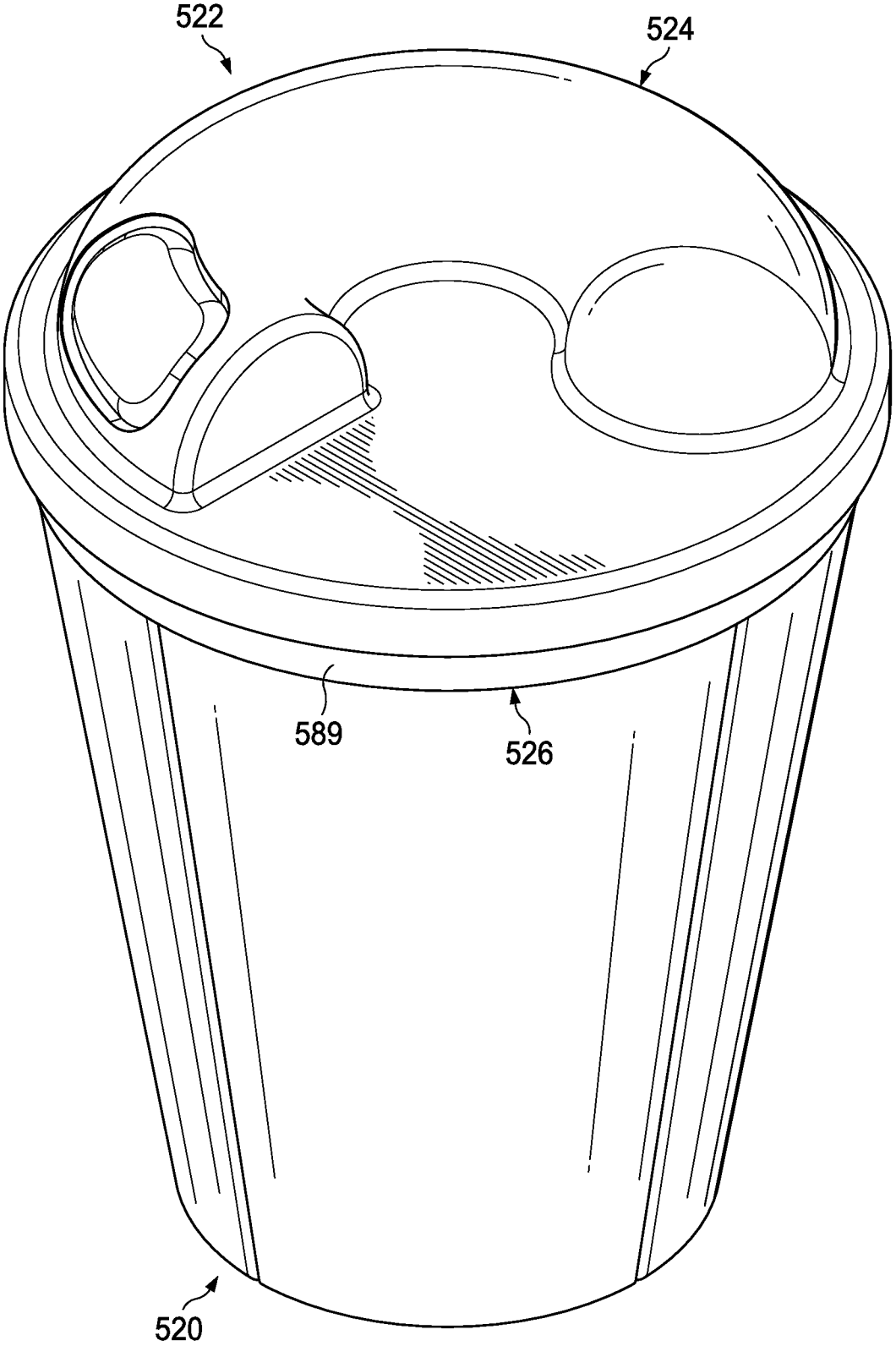
FIG. 19 is an assembled upper isometric view depicting the container and the lid assembly of FIG. 18.

FIGS. 18 and 19 illustrate an alternative embodiment of a container 520 and lid assembly 522 that is similar to, or the same in many respects as, the container 20 and lid assembly 22, respectively, illustrated in FIGS. 1-10. For example, the lid assembly 522 can include an upper lid 524 and a lower lid 526. However, the lower lid 526 can include a radial flange 589 that extends downwardly from a base portion 550. When the upper lid 524 and the lower lid 526 are coupled together and attached to the container 520, the radial flange 589 can be exposed beneath the upper lid 524 such that the radial flange 589 can be grasped by a user to hold the lower lid 526 in place when rotating the upper lid 524 or to facilitate rotation of the lower lid 526 with respect to the container 520.

Figure 20:
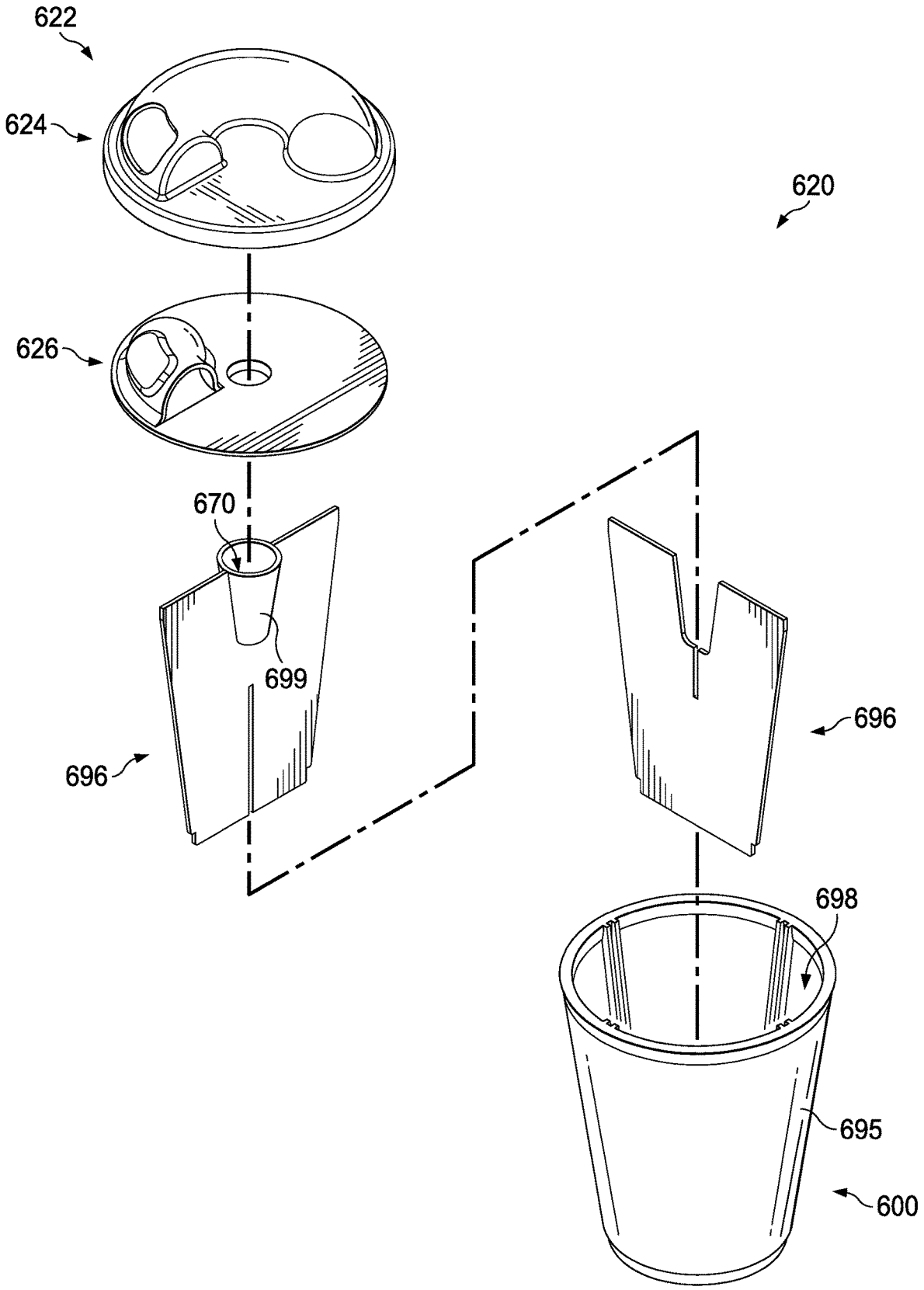
FIG. 20 is an exploded isometric view depicting a container in association with a lid assembly, in accordance with yet another embodiment.

FIG. 20 illustrates an alternative embodiment of a container 620 and lid assembly 622 that is similar to, or the same in many respects as, the container 20 and lid assembly 22, respectively, illustrated in FIGS. 1-10. For example, the lid assembly 622 can include an upper lid 624 and a lower lid 626. However, the container 620 can include a main body 695 and a pair of interior wall members 696 that are slidably coupled with the main body 695 and can be inserted into an interior 698 of the main body 695 to define a plurality of compartments within the interior 698. One of the interior wall members 696 can include a stem portion 699 that defines a receptacle 670 that facilitates rotatable coupling of the lid assembly 622 to the container 620.

Figure 21:
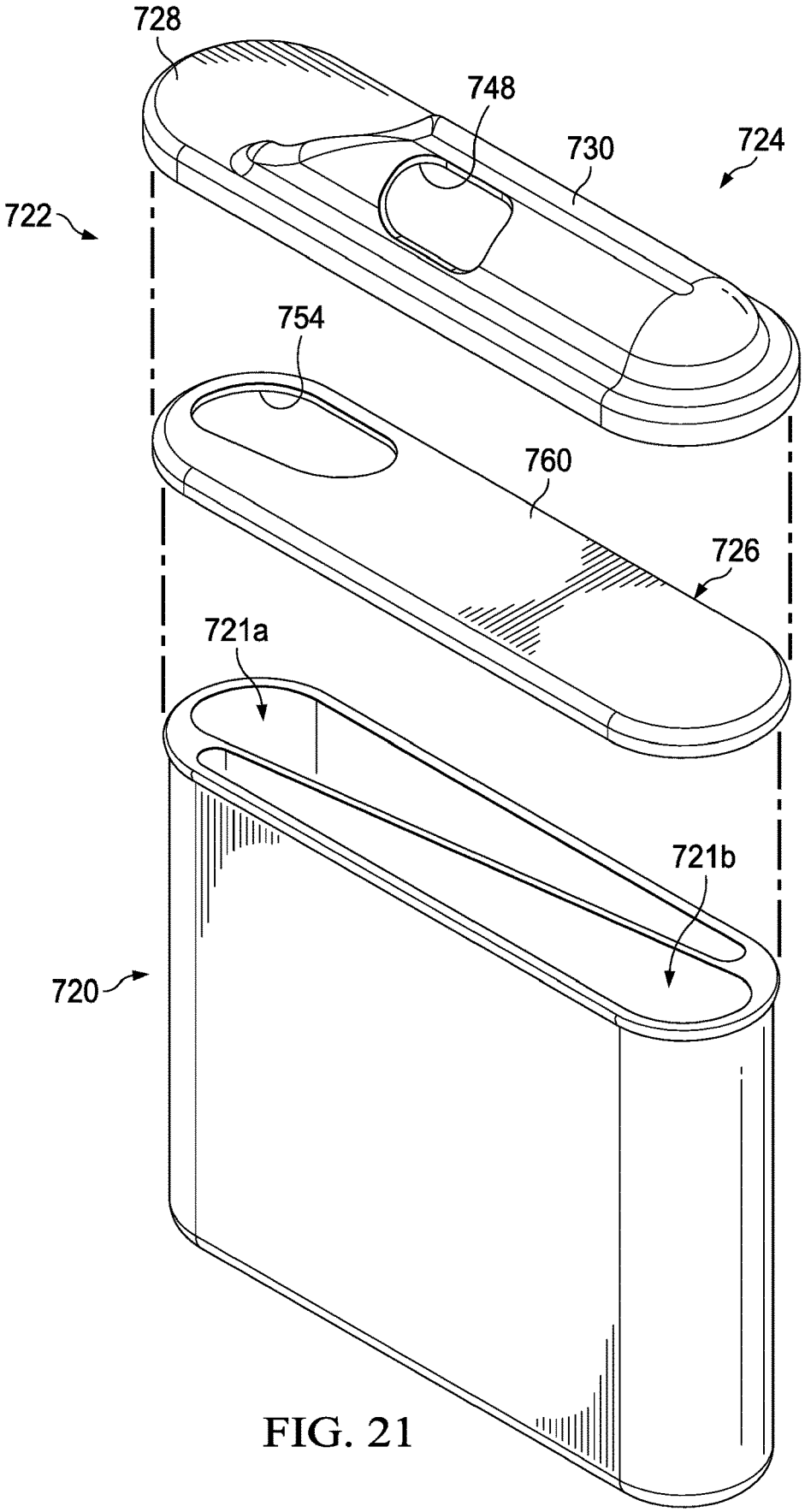
FIG. 21 is an isometric exploded view depicting a container in association with a lid assembly, with an upper lid shown in a closed position, in accordance with still yet another embodiment.

FIGS. 21-26 illustrate an alternative embodiment of a container 720 and lid assembly 722 that is similar to, or the same in many respects as, the container 20 and lid assembly 22, respectively, illustrated in FIGS. 1-10. For example, as illustrated in FIG. 21, the container 720 can include a first compartment 721*a* and a second compartment 721*b*. The lid assembly 722 can include an upper lid 724 and a lower lid 726. The upper lid 724 can include a base portion 728 and a containment portion 730 that extends from the base portion 728. The containment portion 730 can define a dispensation opening 748 that extends to an elongated recess (not shown)

defined by the containment portion 730. The lower lid 726 can define a lower opening 754 and can include an upper surface 760.

Figure 26:
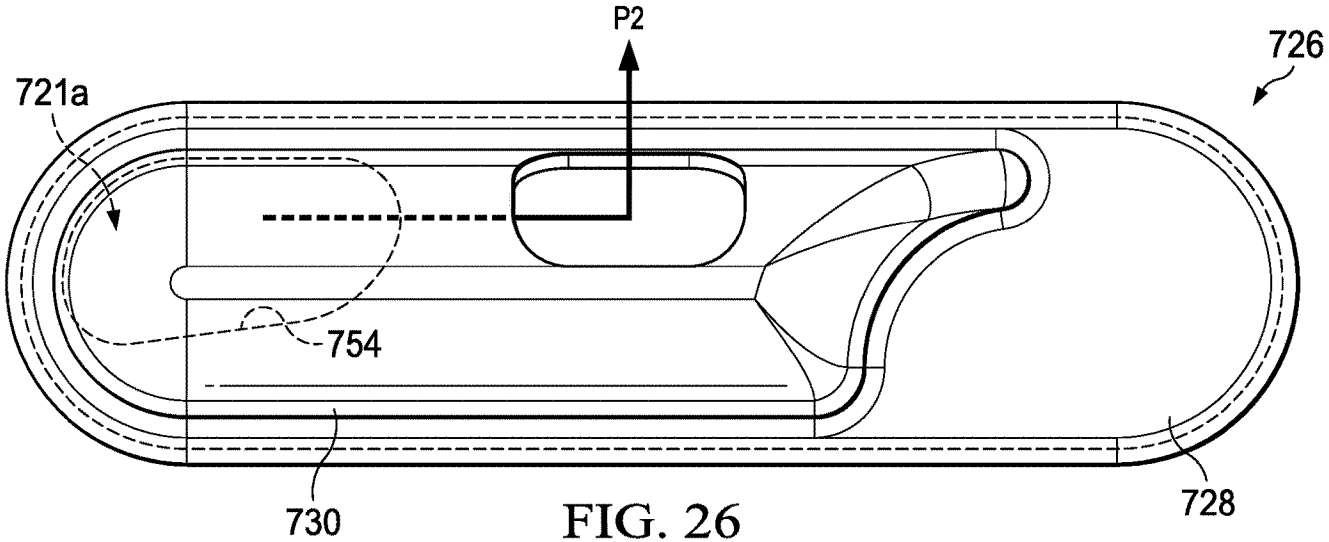
FIG. 26 is an upper plan view depicting the container and lid assembly of FIG. 25.
Figure 25:
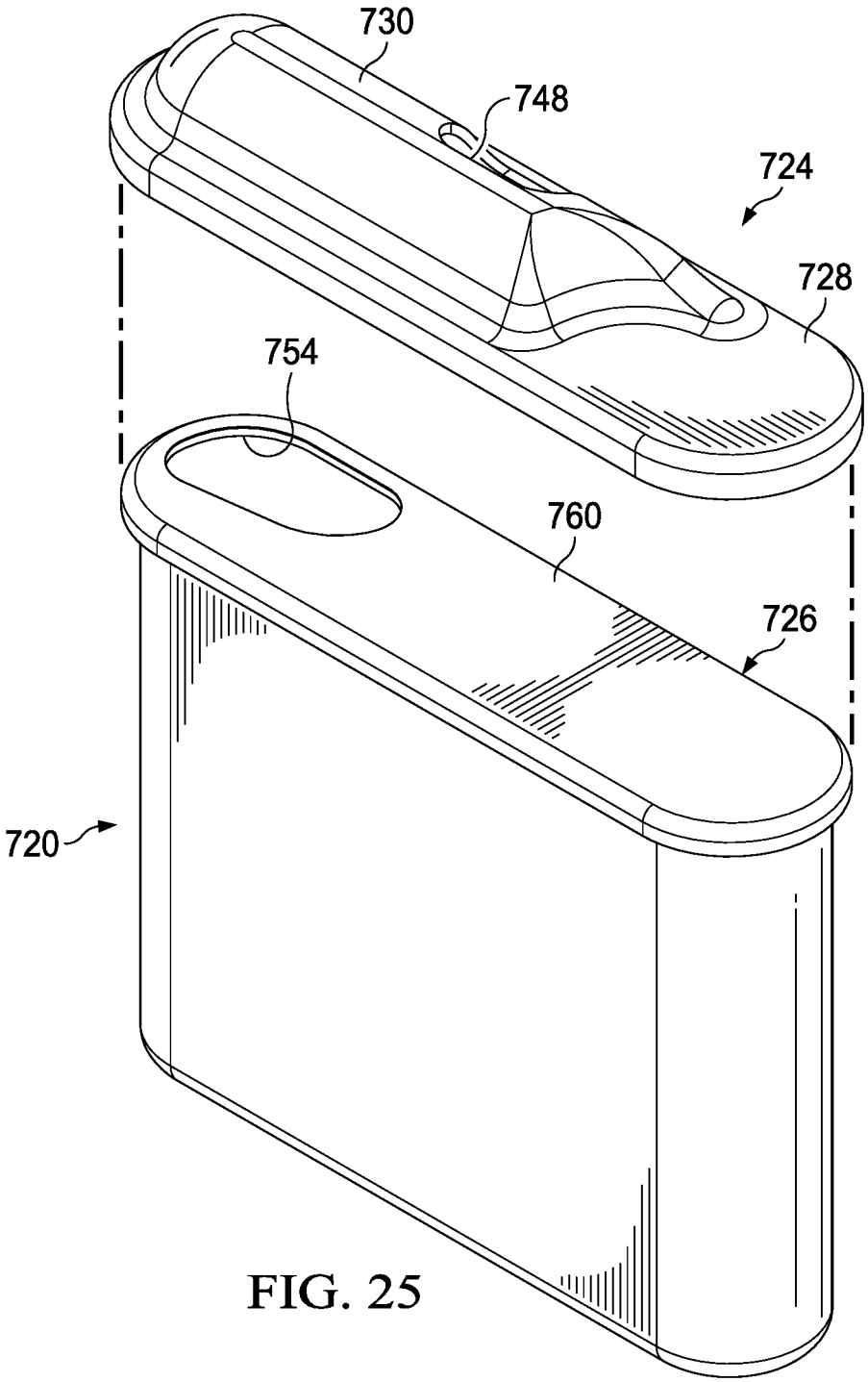
FIG. 25 is an isometric partially exploded view depicting the container and lid assembly of FIG. 21, but with the upper lid shown in a dispensation position.

However, the dispensing function of the lid assembly 722 can be controlled by removing at least one of the upper lid 724 and the lower lid 726 and repositioning it on the container 720 to achieve the desired dispensation function. For example, when the lower lid 726 is provided over the container 720, as shown in solid lines in FIG. 22, the lower opening 754 can be provided over the first compartment 721*a* to facilitate dispensation of contents from the first compartment 721*a*. The upper lid 724 can be manually positioned on the lower lid 726 in either a closed position (FIG. 24) or a dispensation position (FIG. 26). As illustrated with reference to FIGS. 21-24, when the upper lid 724 is in the closed position, the base portion 728 can overlie the lower opening 754 of the lower lid 726 to prevent the contents of the first compartment 721*a* associated with the lower opening 754 from being dispensed from the container 720. As illustrated with reference to FIGS. 25 and 26, when the upper lid 724 is in the dispensation position, the upper lid 724 and the lower lid 726 can cooperate to define a tortuous dispensation path (P2 in FIG. 26) that extends from the dispensation opening 748, through the elongate recess between the containment portion 730 and the upper surface 760, and through the lower opening 754 to the underlying first compartment 721*a*.

Figure 22:
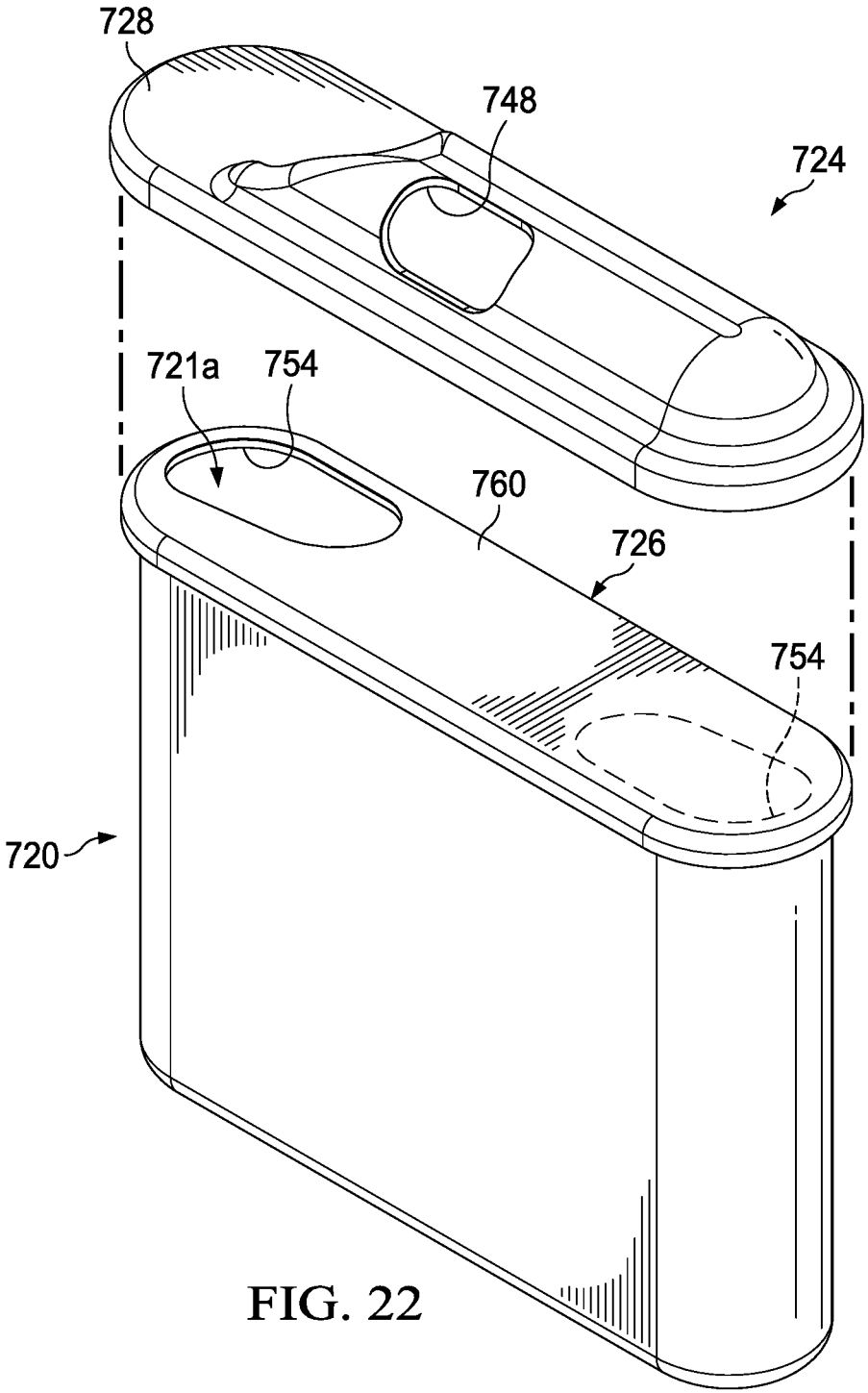
FIG. 22 is an isometric exploded view depicting the container and lid assembly of FIG. 21, with a lower lid shown assembled on the container.
Figure 23:
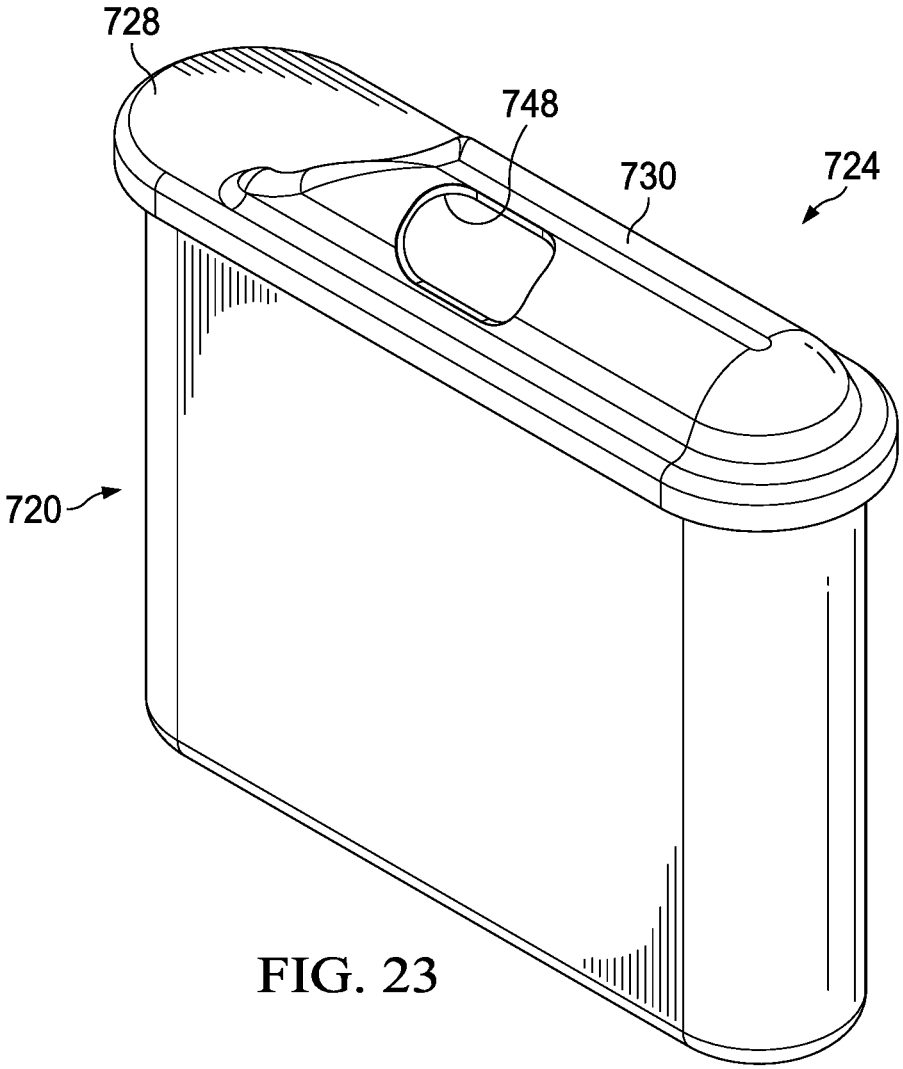
FIG. 23 is an isometric exploded view depicting the container and lid assembly of FIG. 21, with the upper lid and lower lid shown assembled on the container.
Figure 24:
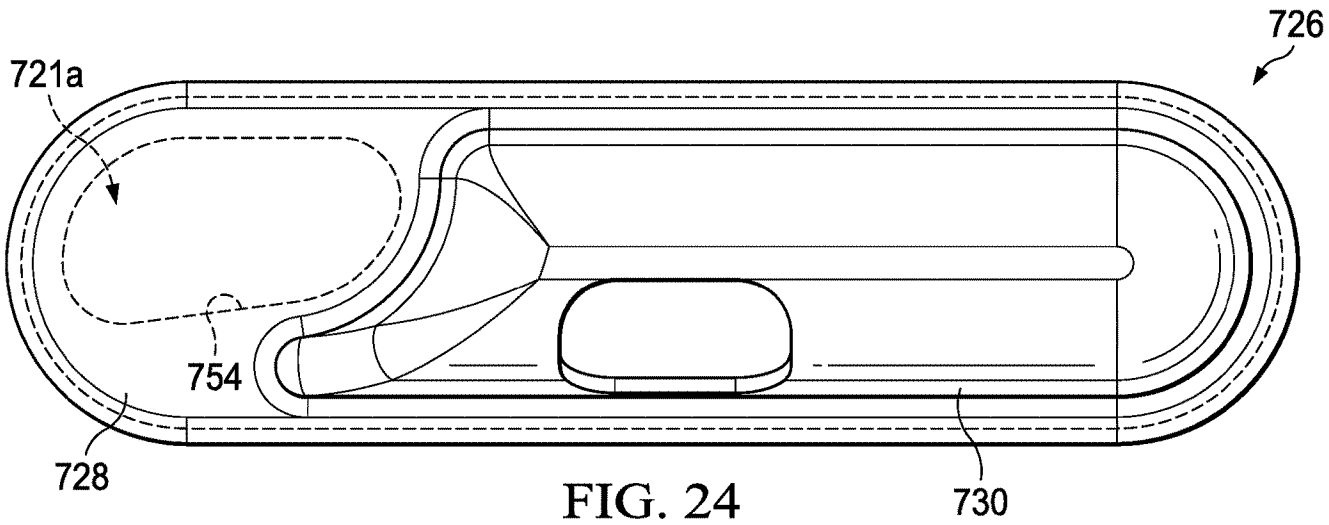
FIG. 24 is an upper plan view depicting the container and lid assembly of FIG. 23.

To facilitate dispensation from the second compartment 721*b*, the lower lid 726 can be removed from the container 720 and reconfigured such that the lower opening 754 is positioned over the second compartment 721*b* (shown in dashed lines in FIG. 22). When the lower lid 726 is in such a position, the upper lid 724 can be positioned on the lower lid 726 in either a closed position or a dispensation position as described above. It is to be appreciated that the container 720 and the lid assembly 722 illustrate a compact arrangement that can be sized to fit within a user's pocket or carrying bag (e.g., a purse).

Figure 27:
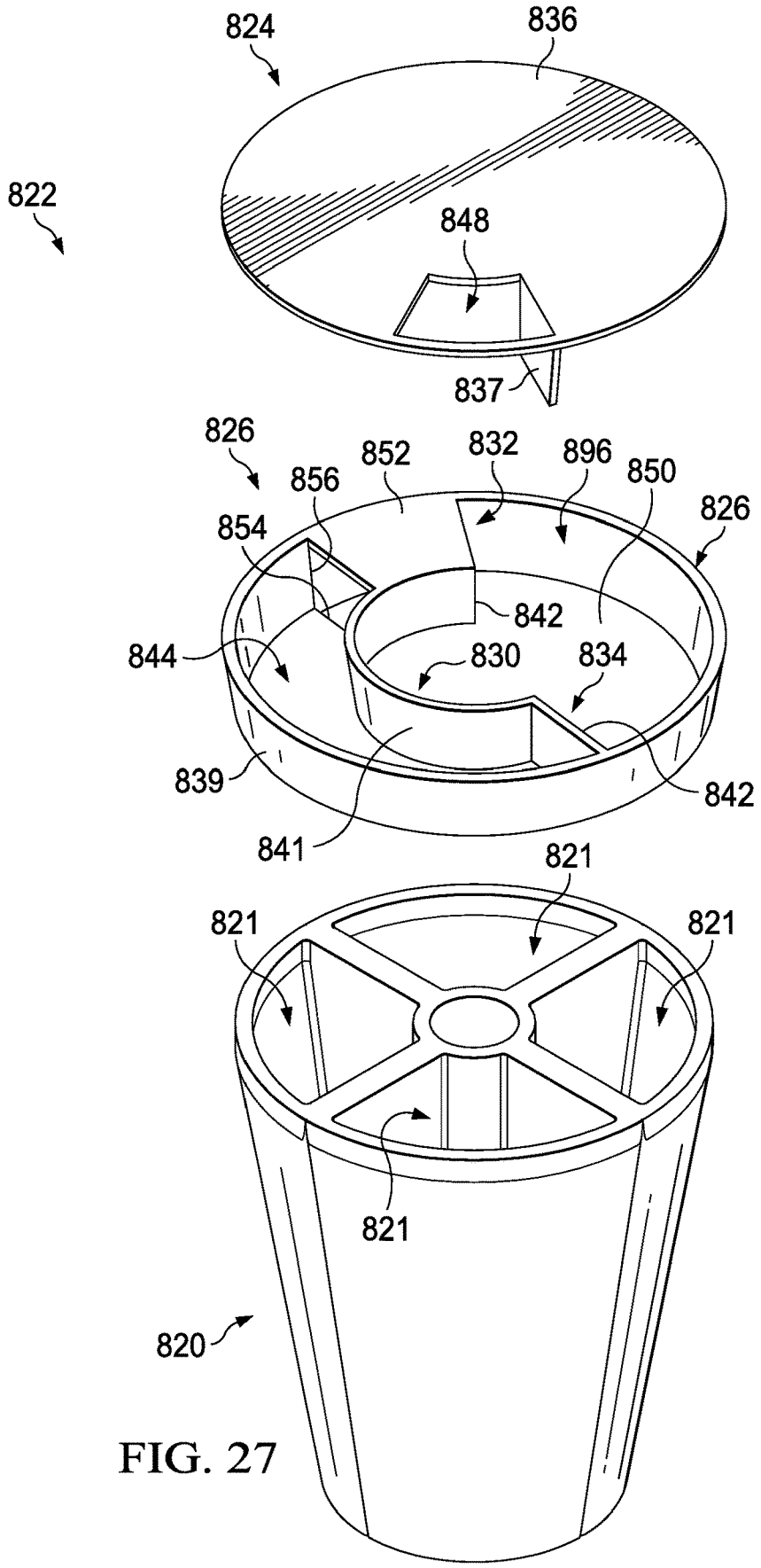
FIG. 27 is an exploded isometric view depicting a container in association with a lid assembly, in accordance with yet another embodiment.
Figure 28:
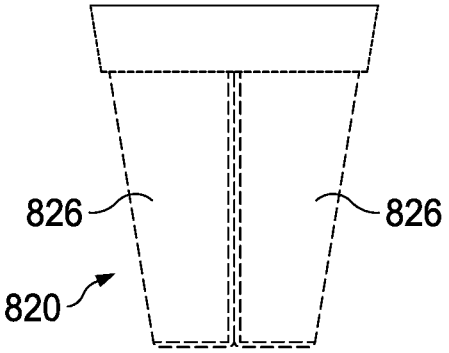
FIG. 28 is a side view depicting the container and lid assembly of FIG. 27.

FIGS. 27-32 illustrate an alternative embodiment of a container 820 and a lid assembly 822 that are similar to, or the same in many respects as, the container 20 and the lid assembly 22 illustrated in FIGS. 1-10. For example, as illustrated in FIGS. 27 and 28, the container 820 can include a plurality of compartments 821. The lid assembly 822 can be rotatably coupled with the container 820 and can include an upper lid 824 and a lower lid 826 (FIG. 27). The upper lid 824 can be pivotally coupled with the lower lid 826. However, as illustrated in FIG. 27, the upper lid 824 can include a central member 836 that is substantially disc-shaped and a tab member 837 that extends from the central member 836. The central member 836 and the tab member 837 can cooperate to define a dispensation opening 848.

The lower lid 826 can include a base portion 850 and a containment portion 830 that extends along the base portion 850 between a first end 832 and a second end 834. The containment portion 830 can be formed by a portion of an exterior sidewall 839, an interior sidewall 841, a pair of end walls 842, a portion of the base portion 850, and a divider 852. The base portion 850 and the divider 852 can cooperate to define a lower opening 854. The divider 852 can be substantially hood-shaped and can substantially overlie the lower opening 854 at the first end 832 of the containment portion 830. The divider 852 can define a lateral opening 856 that is in fluid communication with the lower opening 854. The containment portion 830 can define an elongated recess 844.

The lower lid 826 can also include a storage receptacle 896 that is defined by a portion of the exterior sidewall 839, the interior sidewall 841, the end walls 842 and the base portion 850. In one embodiment, the storage receptacle 896 can serve as an onboard trash receptacle for disposable material (e.g., 197 in FIG. 14). In such an embodiment, the upper lid 824 can be removed to access the storage receptacle 896. Once the disposable material is added to the storage receptacle 896, the upper lid 824 can be reinstalled on the lower lid 826 to store the disposable material. It is to be appreciated that other materials can be stored in the storage receptacle 896 such as nutrition or marketing information (e.g., on a sticker or a folded pamphlet) or a handwritten note.

Figure 29:
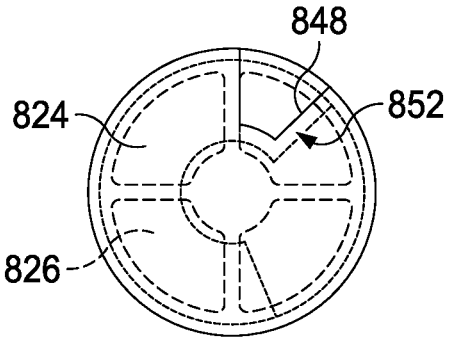
FIG. 29 is a top view depicting the container and lid assembly of FIG. 27 with an upper lid shown in a closed position.
Figure 30:
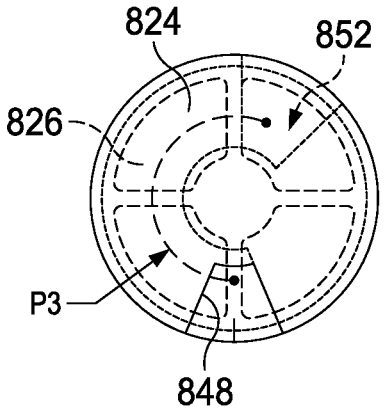
FIG. 30 is a top view depicting the container and lid assembly of FIG. 27 but with the upper lid shown in a dispensing position.

The lid assembly 822 can be rotated with respect to the container 820 to facilitate selection of a compartment 821 from which to dispense product therefrom. The container 820 and/or the lid assembly 822 can include features (not shown) that facilitate indexing of the lid assembly 822 relative to the container 820 to a preselected position that correlates to particular compartment from which to dispense food product therefrom. The upper lid 824 can be pivotable with respect to the lower lid 826 between a closed position (FIG. 29) and a dispensation position (FIG. 30). When the upper lid 824 is in the closed position, as generally illustrated in FIG. 29, the dispensation opening 848 can overlie the divider 852 and the tab member 837 (FIG. 27) can substantially cover the lateral opening 856 of the divider 852. As such, any food product that is provided through the lower opening 854 can be contained within the divider 852 and thus prevented from being dispensed through the dispensation opening 848 or escaping into the rest of the elongated recess 844 (e.g., the portion of the elongated recess 844 that extends between the divider 852 and the second end 834 of the containment portion 830).

When the upper lid 824 is in the dispensation position, as generally illustrated in FIG. 30, the dispensation opening 848 can be spaced further from the divider 852 than when the upper lid 824 is in the closed position, such that the upper lid 824 and the lower lid 826 cooperate to define a dispensation chamber (e.g., 76) that extends between the first end 832 and the second end 834 of the containment portion 830. The upper lid 824 can accordingly cooperate with the containment portion 830 to define a tortuous dispensation path P3 through the upper lid 824 and the lower lid 826 for the contents of the container 820 to be provided to a user.

Figure 31:
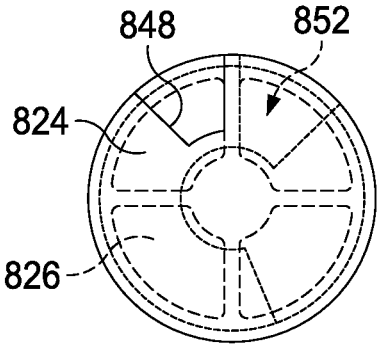
FIG. 31 is a top view depicting the container and lid assembly of FIG. 27 but with the upper lid shown in a different dispensing position.

When the upper lid 824 is in the dispensation position, the location of the tab member 837 relative to the divider 852 can affect the overall volume of the dispensation chamber (e.g., 76) and in some cases can affect the manner in which the product is dispensed from the container 820 and through the lid assembly 822. For example, as illustrated in FIG. 31, the upper lid 824 is shown to be in a more restricted dispensation position (e.g., a pouring position) such that the dispensation opening 848 is located immediately adjacent the lateral opening 856 of the divider 852. In such an arrangement, product can be more easily poured directly from container 820 and through the lid assembly 822. The upper lid 824 and/or the lower lid 826 can include features (not shown) that facilitate indexing of the upper lid 824 to a preselected position that correlates to a different measured amount of food product.

Figure 32:
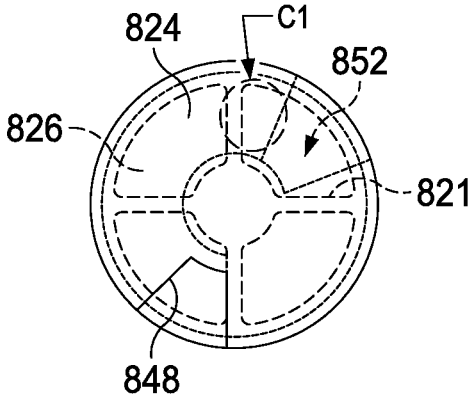
FIG. 32 is a top view depicting the container and lid assembly of FIG. 27 but with a lower lid shown in a restricted flow position.

Referring now to FIG. 32, the lower lid 826 is shown to be in a restricted flow position with the lower opening 854 centrally located over one of the compartments 821. In such an arrangement, when the user tilts the container 820 to dispense product from the compartment and into the dispensation chamber 876, the portion of the part of the base portion 850 that overhangs the compartment 821 (encircled in a dashed line C1), can partially block the compartment 821. As such, the flow of product into the dispensation chamber (e.g., 76) is reduced to enhance the user's control of the amount of product that is being dispensed into the dispensation chamber (e.g., 76).

Figure 33:
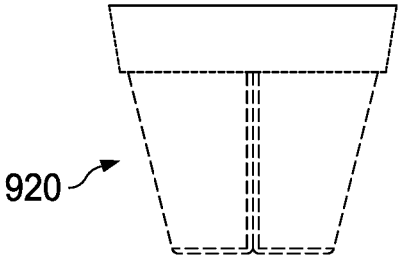
FIG. 33 is a side view depicting a container in association with a lid assembly, in accordance with yet another embodiment.

FIG. 33 illustrates an alternative embodiment of a container 920 that is similar to, or the same in many respects as, the container 820 shown in FIGS. 27-32. However, the container 920 is shorter and thus has less volume than the container 820.

Figure 35:
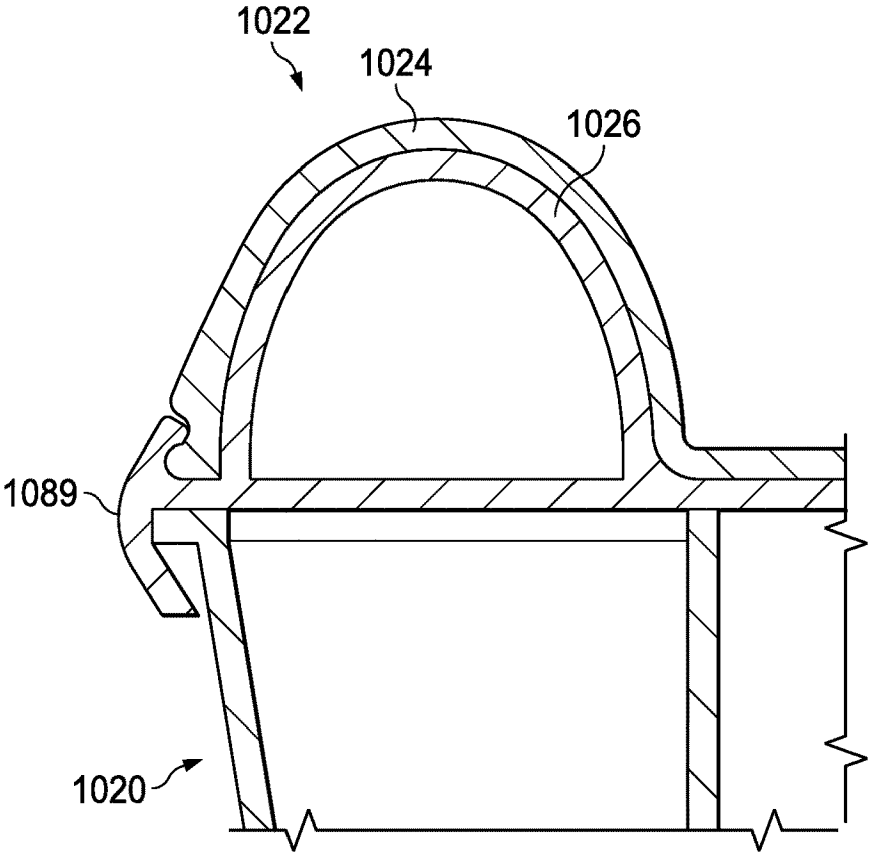
FIG. 35 is an enlarged section view of the container and lid assembly of FIG. 34.
Figure 34:
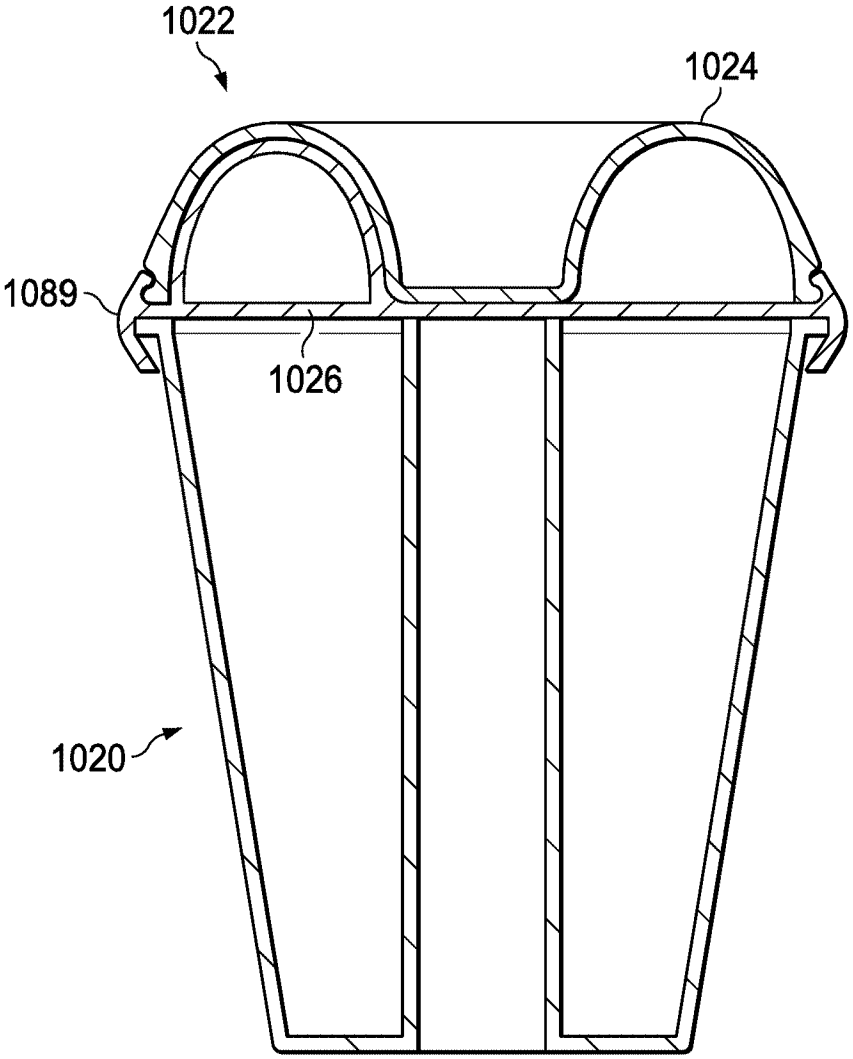
FIG. 34 is a section view depicting a container in association with a lid assembly, in accordance with still yet another embodiment.

FIGS. 34 and 35 illustrate an alternative embodiment of a container 1020 and a lid assembly 1022 that are similar to, or the same in many respects as, the container 20 and the lid assembly 22 illustrated in FIGS. 1-10. For example, the lid assembly 1022 can include an upper lid 1024 and a lower lid 1026. However, the lower lid 1026 can include a radial flange 1089 that overlaps a portion of the upper lid 1024 and a portion of the container 1020 to facilitate rotatable coupling between the lid assembly 1022 and the container 1020 and pivotal coupling between the upper lid 1024 and the lower lid 1026. The radial flange 1089 can accordingly be provided in lieu of other pivotable/rotatable attachment features for the container 1020 and the lid assembly 1022 (e.g., the receptacle 62, the projection 64, and the projection 66 described above). The radial flange 1089 can also facilitate grasping of the lower lid 1026. For example, when the upper lid 1024 and the lower lid 1026 are coupled together and attached to the container 1020, the radial flange 1089 can be exposed around a circumference of the container 1020 such that the radial flange 1089 can be grasped by a user to hold the lower lid 1026 in place when rotating the upper lid 1024 or to facilitate rotation of the lower lid 1026 with respect to the container 1020.

Figure 36:
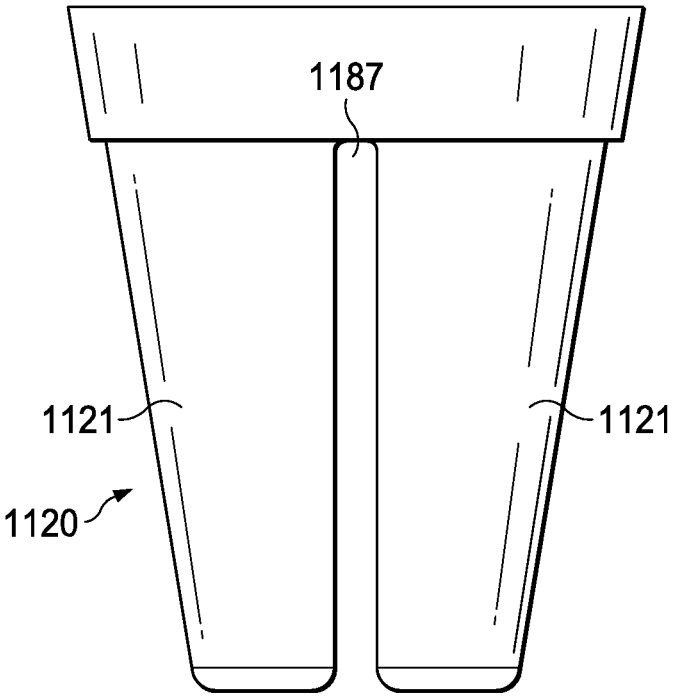
FIG. 36 is a side view depicting a container in association with a lid assembly, with the container shown in a stackable configuration, in accordance with still yet another embodiment.
Figure 37:
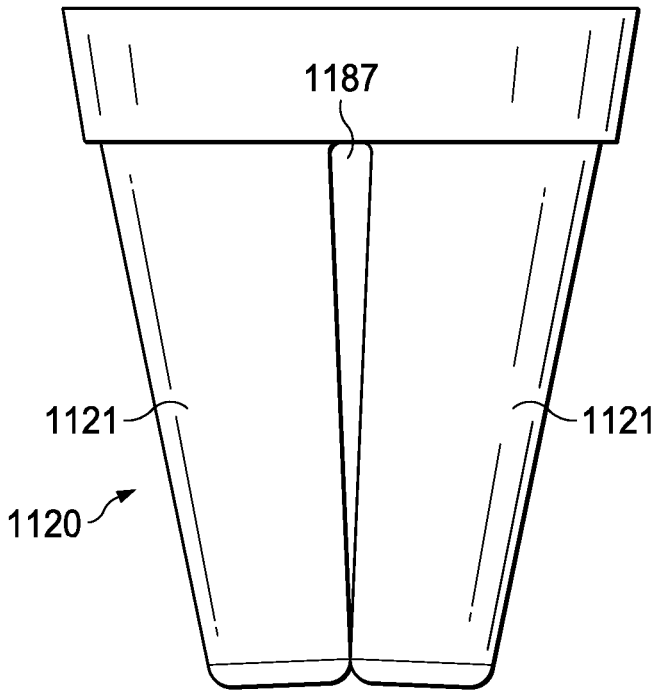
FIG. 37 is a side view depicting the container and lid assembly of FIG. 37, but with the container shown in an assembled configuration.

FIGS. 36 and 37 illustrate an alternative embodiment of a container 1120 that is similar to or the same as the container 820 shown in FIGS. 27-32. For example, the container 1120 can include a plurality of compartments 1121. The container 1120 can be selectively configured in either a stackable configuration (FIG. 36) or an assembled configuration (FIG. 37). When in the stackable configuration, the compartments 1121 can be spaced from each other to allow for stacking of multiple containers 1120 on top of each other. When in the assembled configuration, the compartments 1121 can be attached together at a bottom portion but can collectively define a gap 1187 at an upper portion of the container 1120. This gap 1187 can be a function of the manufacturing tolerances that are present when thermoforming the container 1120 (e.g., through extrusion molding, injection molding, or blow molding) or other manufacturing process.

Figure 38:
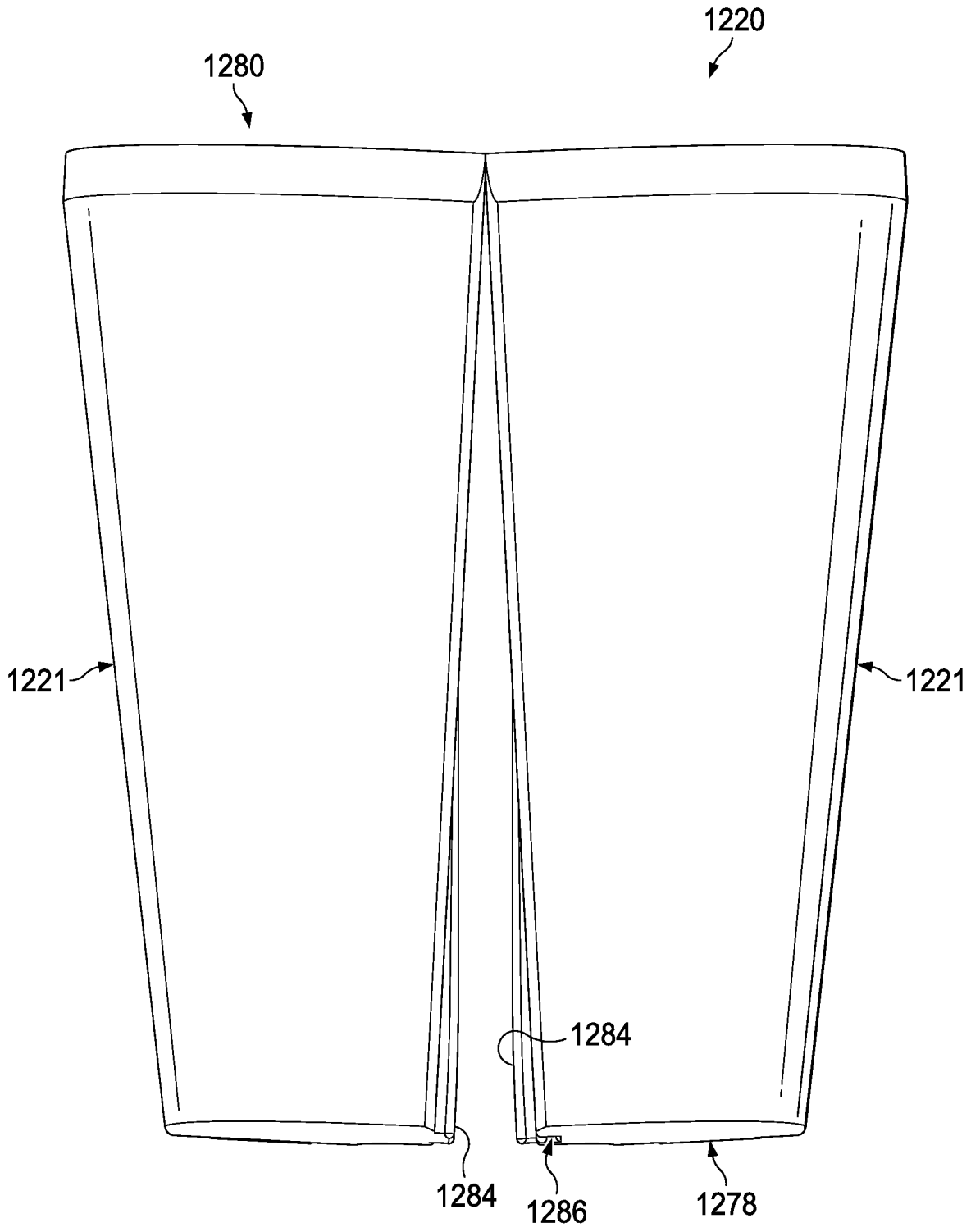
FIG. 38 is a side view depicting a container in association with a lid assembly, with the container shown in a stackable configuration, in accordance with still yet another embodiment.

FIG. 38 illustrates an alternative embodiment of a container 1220 that is similar to, or the same in many respects as, the container 20 shown in FIGS. 1-10. For example, the container 1220 can include a plurality of compartments 1221. Each of the compartments 1221 can include either a locking tab 1284 or a receptacle 1286 at a bottom portion 1278 of the container 1220. Each locking tab 1284 can cooperate with an opposing receptacle 1286 to facilitate selective attachment of the compartments 1221 together along the bottom portion 1278. However, as illustrated in FIG. 38, the locking tabs 1284 can extend about halfway up the compartments 1221 and can taper inwardly as they extend towards an upper portion 1280. The opposing receptacles (e.g., 1286) can have a corresponding shape (e.g., tapering upwardly) as the associated locking tabs 1284 to allow for a friction fit therebetween when the compartments 1221 are snapped together. It is to be appreciated that the shape of the locking tabs 1284 and the receptacles 1286 can allow for easier thermoforming of the container 1220 (e.g., through extrusion molding, injection molding, or blow molding).

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. An apparatus comprising:

a container having a central axis; and a lid assembly coupled with the container, the lid assembly comprising:

an upper lid defining a curved elongated recess and a dispensation opening extending to the curved elongated recess; and a lower lid at least partially defining a lower opening in fluid communication with the curved elongated recess, such that the lower lid and the upper lid cooperate to define a dispensation chamber;

wherein:

when the upper lid is in a first position, the lower opening is proximate the dispensation opening;

when the upper lid is in a second position, the lower opening is spaced further from the dispensation opening than when the upper lid is in the first position, and the lower lid cooperates with the upper lid to define a tortuous path through the dispensation opening, through the dispensation chamber, and through the lower opening; and the upper lid rotates between the first position and the second position along a rotational axis, the rotational axis being aligned with the central axis of the container.

2. The apparatus of claim 1 wherein:

the container comprises a plurality of compartments; and the lid assembly overlies the plurality of compartments.

3. The apparatus of claim 2 wherein the container comprises a bottom portion and is selectively configured in one of an assembled configuration and a stackable configuration, wherein:

when the container is in the stackable configuration, each compartment of the plurality of compartments can be spaced from each other at the bottom portion of the container; and when the container is in the assembled configuration, each compartment of the plurality of compartments can be secured to each other at the bottom portion of the container.

4. The apparatus of claim 2 wherein the container comprises an upper portion and each compartment of the plurality of compartments is coupled to an adjacent compartment at the upper portion of the container by a cross-web member.

5. The apparatus of claim 2 wherein the plurality of compartments defines a receptacle that is located between the plurality of compartments and the container defines a deformation feature that is disposed adjacent to the receptacle.

6. The apparatus of claim 2 further comprising a sealing substrate disposed over the plurality of compartments and configured for selective removal from the container.

7. The apparatus of claim 6 wherein:

the sealing substrate comprises separate sealing portions that each correspond to a respective compartment of the plurality of compartments; and each of the sealing portions are configured to be selectively separated from adjacent ones of the sealing portions.

8. The apparatus of claim 2 wherein the container defines a storage receptacle adjacent to the plurality of compartments.

9. The apparatus of claim 2 wherein each compartment of the plurality of compartments comprises at least one of a locking tab and a receptacle, wherein the at least one of a locking tab and the receptacle facilitates releasable coupling of each compartment of the plurality of compartments with an adjacent compartment.

10. The apparatus of claim 1 wherein:

the lower lid comprises a divider;

the divider overlies the lower opening and defines a lateral opening that is in fluid communication with the lower opening; and the tortuous path is further defined by the lateral opening.

11. The apparatus of claim 10 wherein the upper lid, the lower lid, and the container are each formed as an individual unitary one-piece construction.

* * * * *